US011269268B2

(12) United States Patent
Sato

(10) Patent No.: US 11,269,268 B2
(45) Date of Patent: Mar. 8, 2022

(54) DEVELOPER CONTAINER AND IMAGE FORMING DEVICE

(71) Applicant: BROTHER KOGYO KABUSHIKI KAISHA, Nagoya (JP)

(72) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/128,313

(22) Filed: Dec. 21, 2020

(65) Prior Publication Data

US 2021/0109458 A1 Apr. 15, 2021

Related U.S. Application Data

(63) Continuation of application No. 16/846,471, filed on Apr. 13, 2020, now Pat. No. 10,901,341, which is a (Continued)

(30) Foreign Application Priority Data

Sep. 30, 2009 (JP) ..... 2009-227952

(51) Int. Cl.
*G03G 15/08* (2006.01)
*G03G 21/12* (2006.01)
*G03G 21/10* (2006.01)

(52) U.S. Cl.
CPC ..... *G03G 15/0886* (2013.01); *G03G 15/0865* (2013.01); *G03G 15/0868* (2013.01); *G03G 21/105* (2013.01); *G03G 21/12* (2013.01)

(58) Field of Classification Search
CPC ..... G03G 15/0886; G03G 15/0865; G03G 15/0868; G03G 21/105; G03G 21/12
See application file for complete search history.

(56) References Cited

U.S. PATENT DOCUMENTS 3,566,834 A 3/1971 Tamai et al.
3,950,092 A * 4/1976 Zoltner ..... G03G 21/105 399/358

(Continued)

FOREIGN PATENT DOCUMENTS

JP 6-186845 7/1994
JP H07-225514 8/1995

(Continued)

OTHER PUBLICATIONS

Notice of Allowance dated Jan. 17, 2012 received from the Japanese Patent Office from related Japanese Application No. 2009-227952, together with an English-language translation.

(Continued)

*Primary Examiner* — David J Bolduc
(74) *Attorney, Agent, or Firm* — Scully, Scott, Murphy & Presser, PC

(57) ABSTRACT

A developer container includes a casing having a developer accommodating chamber and a waste-developer accommodating chamber, conveying member, a conveying-member accommodating unit, and a supporting member. The conveying member conveys waste developer in a longitudinal direction of the waste-developer accommodating chamber. The conveying-member accommodating unit accommodates the conveying member therein and has a first opening and a second opening. The first opening is provided in an upstream end portion and allows the waste developer to move from outside of the conveying-member accommodating unit to the inside of the conveying-member accommodating unit. The second opening allows the waste-developer to move from the inside of the conveying-member accommodating unit to the waste-developer accommodating chamber. The supporting member is provided on the casing. The supporting member supports the conveying-member accommodating unit such that the conveying-member accommo- (Continued)

dating unit is movable in directions perpendicular to the longitudinal direction relative to the casing.

20 Claims, 11 Drawing Sheets

Related U.S. Application Data continuation of application No. 16/443,272, filed on Jun. 17, 2019, now Pat. No. 10,656,560, which is a continuation of application No. 15/703,466, filed on Sep. 13, 2017, now Pat. No. 10,338,498, which is a continuation of application No. 15/195,444, filed on Jun. 28, 2016, now Pat. No. 9,798,269, which is a continuation of application No. 14/959,040, filed on Dec. 4, 2015, now Pat. No. 9,383,717, which is a continuation of application No. 14/570,795, filed on Dec. 15, 2014, now Pat. No. 9,207,572, which is a continuation of application No. 13/949,854, filed on Jul. 24, 2013, now Pat. No. 8,913,921, which is a continuation of application No. 13/754,395, filed on Jan. 30, 2013, now Pat. No. 8,521,062, which is a continuation of application No. 12/727,721, filed on Mar. 19, 2010, now Pat. No. 8,369,745.

(56) References Cited

U.S. PATENT DOCUMENTS

| | | | | |
|---|---|---|---|---|
| 4,297,021 | A | 10/1981 | Tani | |
| 4,963,940 | A | 10/1990 | Nemoto et al. | |
| 4,982,771 | A | 1/1991 | Bertram et al. | |
| 5,084,734 | A | 1/1992 | Yoshino et al. | |
| 5,250,997 | A * | 10/1993 | Kaneko | G03G 21/105 399/99 |
| 5,335,051 | A | 8/1994 | Tani | |
| 5,381,217 | A | 1/1995 | Ishida | |
| 5,608,501 | A | 3/1997 | Makino | |
| 5,778,296 | A * | 7/1998 | van der Steen | G03G 21/105 399/358 |
| 5,781,841 | A * | 7/1998 | Kouroku | G03G 21/12 399/35 |
| 5,822,666 | A * | 10/1998 | Haneda | G03G 15/166 399/309 |
| 5,933,696 | A * | 8/1999 | Howard | G03G 21/105 399/360 |
| 6,021,292 | A * | 2/2000 | Nakajima | G03G 21/12 222/DIG. 1 |
| 6,041,212 | A | 3/2000 | Okada | |
| 6,167,211 | A | 12/2000 | Oogi et al. | |
| 6,363,233 | B1 | 3/2002 | Nakajima | |
| 6,493,516 | B2 | 12/2002 | Murakami et al. | |
| 6,496,671 | B2 | 12/2002 | Nakajima | |
| 6,526,246 | B2 | 2/2003 | Iwata et al. | |
| 6,804,484 | B2 | 10/2004 | Hashimoto et al. | |
| 6,882,821 | B2 | 4/2005 | Jeong et al. | |
| 7,062,205 | B2 | 7/2006 | Nagashiro | |
| 7,190,925 | B2 | 3/2007 | Isomura et al. | |
| 7,257,355 | B2 | 8/2007 | Tomoe et al. | |
| 7,634,213 | B2 | 12/2009 | Yoshida et al. | |
| 7,660,541 | B2 | 2/2010 | Tanimoto et al. | |
| 7,702,262 | B2 | 4/2010 | Taguchi et al. | |
| 7,856,198 | B2 | 12/2010 | Saito et al. | |
| 8,126,340 | B2 | 2/2012 | Bito et al. | |
| 2001/0001025 | A1 | 5/2001 | Nakajima | |
| 2002/0064395 | A1 | 5/2002 | Funayama et al. | |
| 2003/0068174 | A1 | 4/2003 | Hashimoto | |
| 2004/0047651 | A1 | 3/2004 | Koyama et al. | |
| 2007/0031164 | A1 | 2/2007 | Ota | |
| 2007/0217816 | A1 | 9/2007 | Shiraki | |
| 2007/0280730 | A1 | 12/2007 | Okabe et al. | |
| 2008/0080903 | A1 | 4/2008 | Noguchi | |
| 2008/0124119 | A1 | 5/2008 | Oda | |
| 2008/0166162 | A1 | 7/2008 | Hayashi et al. | |
| 2008/0170890 | A1 | 7/2008 | Nishimura et al. | |
| 2008/0267661 | A1 | 10/2008 | Yoshida et al. | |
| 2008/0279581 | A1 | 11/2008 | Shimizu | |
| 2008/0317484 | A1 | 12/2008 | Tanimoto et al. | |
| 2009/0035014 | A1 | 2/2009 | Sato | |
| 2009/0136259 | A1 | 5/2009 | Ito | |
| 2009/0185824 | A1 | 7/2009 | Murakami et al. | |
| 2009/0232548 | A1 | 9/2009 | d'Entrecasteaux | |
| 2009/0311009 | A1 | 12/2009 | Naiki et al. | |
| 2009/0324284 | A1 | 12/2009 | Ohta | |
| 2010/0074646 | A1 | 3/2010 | Miyahara et al. | |
| 2010/0119270 | A1 * | 5/2010 | Hoshino | G03G 21/105 399/358 |
| 2010/0209157 | A1 | 8/2010 | Sato et al. | |
| 2010/0272467 | A1 | 10/2010 | Sato | |
| 2011/0110694 | A1 | 5/2011 | Ishikake | |
| 2011/0142494 | A1 * | 6/2011 | Oda | G03G 15/0898 399/119 |
| 2011/0158723 | A1 | 6/2011 | Yokokawa | |
| 2011/0262189 | A1 | 10/2011 | Saito | |
| 2012/0275804 | A1 * | 11/2012 | Watanabe | G03G 15/0189 399/39 |

FOREIGN PATENT DOCUMENTS

| | | |
|---|---|---|
| JP | H08-015971 | 1/1996 |
| JP | H10-171246 | 6/1998 |
| JP | H11-143193 | 5/1999 |
| JP | 2000-089530 | 3/2000 |
| JP | 2000-181224 | 6/2000 |
| JP | 2003-043886 | 2/2003 |
| JP | 2003-107872 | 4/2003 |
| JP | 2005-266219 | 9/2005 |
| JP | 2006-017843 | 1/2006 |
| JP | 2007-025511 | 2/2007 |
| JP | 2008-065095 | 3/2008 |
| JP | 2008-083476 | 4/2008 |
| JP | 2009-116142 | 5/2009 |
| JP | 2009-128754 | 6/2009 |
| JP | 2009-157314 | 7/2009 |
| JP | 2010-078847 | 4/2010 |
| JP | 2010-191012 | 9/2010 |
| JP | 2010-191013 | 9/2010 |
| JP | 2010-256827 | 11/2010 |

OTHER PUBLICATIONS

Notice of Allowance dated Oct. 3, 2012 from parent application U.S. Appl. No. 12/727,721.

Office Action dated Mar. 13, 2014 from parent application U.S. Appl. No. 13/949,854.

Notice of Allowance dated Aug. 8, 2014 from parent application U.S. Appl. No. 13/949,854.

Machine Translation of JP 2003043886 A.

Notice of Allowance dated Aug. 4, 2015 from parent application U.S. Appl. No. 14/570,795.

Notice of Allowance dated Mar. 7, 2016 from related application U.S. Appl. No. 14/959,040.

Office Action dated Apr. 10, 2017 from related application U.S. Appl. No. 15/195,444.

Notice of Allowanced dated Jun. 26, 2017 from related application U.S. Appl. No. 15/195,444.

Office Action dated Apr. 6, 2018 from related application U.S. Appl. No. 15/703,466.

Office Action dated Nov. 1, 2018 from related application U.S. Appl. No. 15/703,466.

Notice of Allowance dated Feb. 28, 2019 from related application U.S. Appl. No. 15/703,466.

Notice of Allowance dated Jan. 14, 2020 from related application U.S. Appl. No. 16/443,272.

Office Action dated May 29, 2020 from related application U.S. Appl. No. 16/846,471.

(56) References Cited

OTHER PUBLICATIONS

Notice of Allowance dated Sep. 21, 2020 from related application U.S. Appl. No. 16/846,471.

* cited by examiner

DEVELOPER CONTAINER AND IMAGE FORMING DEVICE

CROSS REFERENCE TO RELATED APPLICATION

This application is a continuation of U.S. application Ser. No. 16/846,471 filed on Apr. 13, 2020, which is a continuation of U.S. application Ser. No. 16/443,272 filed on Jun. 17, 2019, now U.S. Pat. No. 10,656,560 granted May 19, 2020, which is a continuation of U.S. application Ser. No. 15/703,466 filed on Sep. 13, 2017, now U.S. Pat. No. 10,338,498 granted Jul. 2, 2019, which is a continuation application of U.S. application Ser. No. 15/195,444 filed on Jun. 28, 2016, now U.S. Pat. No. 9,798,269 granted Oct. 24, 2017, which is a continuation of U.S. application Ser. No. 14/959,040 filed on Dec. 4, 2015, now U.S. Pat. No. 9,383,717 granted Jul. 5, 2016, which is a continuation of U.S. application Ser. No. 14/570,795 filed on Dec. 15, 2014, now U.S. Pat. No. 9,207,572 granted Dec. 8, 2015, which is a continuation of U.S. application Ser. No. 13/949,854 filed on Jul. 24, 2013, now U.S. Pat. No. 8,913,921 granted on Dec. 16, 2014, which is a continuation application of U.S. application Ser. No. 13/754,395 filed Jan. 30, 2013, now U.S. Pat. No. 8,521,062 granted Aug. 27, 2013, which is a continuation application of U.S. application Ser. No. 12/727,721 filed Mar. 19, 2010, now U.S. Pat. No. 8,369,745 granted Feb. 5, 2013, which claims priority from Japanese Patent Application No. 2009-227952 filed Sep. 30, 2009. The entire contents of each of which are incorporated herein by reference.

TECHNICAL FIELD

The present invention relates to a developer container and an image forming device.

BACKGROUND

One electrophotographic color printer well known in the art is a tandem color laser printer equipped with four photosensitive drums to support the use of toner in the four colors yellow, magenta, cyan, and black. Each of four photosensitive drums corresponds to one of four developer cartridges for supplying developer to the corresponding photosensitive drum. One such tandem color laser printer includes a developing unit having a toner cartridge for accommodating toner for each color as developer cartridge. The toner cartridge has a toner accommodating section for accommodating fresh toner and a waste-toner accommodating section for accommodating waste toner.

The toner cartridge provided in the developing unit is formed with a lower toner supply port for supplying toner therethrough and with a recovery port for recovering waste toner therethrough. A toner discharging section of the waste-developer collecting section for conveying waste toner is fitted into the recovery port. Waste toner from the waste-developer collecting section is supplied to the waste-toner accommodating section through the recovery port.

Hence, if vibrations occur due to driving of the photosensitive drum during an image forming operation, the vibrations may be transmitted to the toner discharging section fitted in the recovery port of the toner cartridge, causing the toner discharging section to be damaged or causing waste toner to leak through a gap between the recovery port and the toner discharging section.

SUMMARY

In view of the foregoing, it is an object of the invention to provide a developer container capable of recovering waste toner reliably and preventing the waste toner from leaking.

In order to attain the above and other objects, the invention provides a developer container including a casing, a conveying member, a conveying-member accommodating unit, and a supporting member. The casing extends in a longitudinal direction and has a developer accommodating chamber and a waste-developer accommodating chamber. The developer accommodating chamber is configured to accommodate developer therein. The waste-developer accommodating chamber is configured to accommodate waste developer therein. The casing has a first end and a second end opposite the first end in the longitudinal direction. The conveying member is configured to convey the waste developer in a conveying direction defined to be directed from the first end to the second end. The conveying-member accommodating unit is configured to accommodate the conveying member therein. The conveying-member accommodating unit has an upstream end portion and a downstream end portion in the conveying direction. The conveying-member accommodating unit has a first opening and a second opening. The first opening is provided in the upstream end portion and provides fluid communication between inside of the conveying-member accommodating unit and outside of the conveying-member accommodating unit to allow the waste developer to move from the outside of the conveying-member accommodating unit to the inside of the conveying-member accommodating unit. The second opening provides fluid communication between the inside of the conveying-member accommodating unit and the waste-developer accommodating chamber to allow the waste-developer to move from the inside of the conveying-member accommodating unit to the waste-developer accommodating chamber. The supporting member is provided on the casing. The supporting member supports the conveying-member accommodating unit such that the conveying-member accommodating unit is movable in directions perpendicular to the longitudinal direction relative to the casing.

According to another aspect, the present invention provides an image forming device including a developer container, an image forming unit, and a waste-developer collecting unit. The image forming unit is configured to form an image using developer supplied from the developer container. The waste-developer collecting unit is configured to collect waste toner. The developer container includes a casing, a conveying member, a conveying-member accommodating unit, and a supporting member. The casing extends in a longitudinal direction and has a developer accommodating chamber and a waste-developer accommodating chamber. The developer accommodating chamber is configured to accommodate developer therein. The waste-developer accommodating chamber is configured to accommodate waste developer therein. The casing has a first end and a second end opposite the first end in the longitudinal direction. The conveying member is configured to convey the waste developer in a conveying direction defined to be directed from the first end to the second end. The conveying-member accommodating unit is configured to accommodate the conveying member therein. The conveying-member accommodating unit has an upstream end portion and a downstream end portion in the conveying direction. The conveying-member accommodating unit has a first opening and a second opening. The first opening is provided in the upstream end portion and provides fluid communication between inside of the conveying-member accommodating unit and outside of the conveying-member accommodating unit to allow the waste developer to move from the outside of the conveying-member accommodating unit to the inside of the conveying-member accommodating unit. The second opening provides fluid communication between the inside of the conveying-member accommodating unit and the waste-developer accommodating chamber to allow the waste-developer to move from the inside of the conveying-member accommodating unit to the waste-developer accommodating chamber. The supporting member is provided on the casing. The supporting member supports the conveying-member accommodating unit such that the conveying-member accommodating unit is movable in directions perpendicular to the longitudinal direction relative to the casing.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
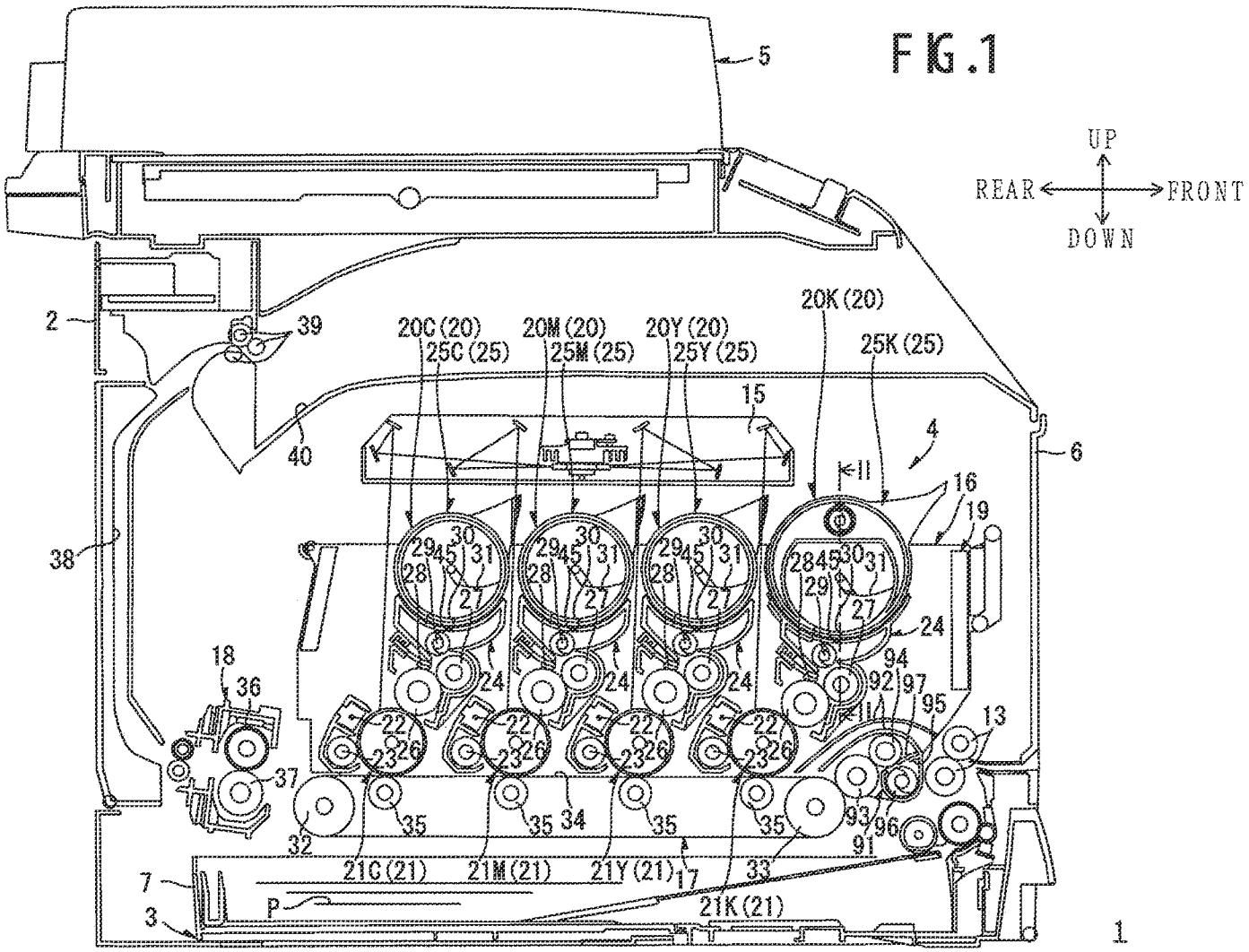
FIG. 1 is a side cross-sectional view of an image forming device including a developer container according to illustrative aspects of the invention.

As shown in FIG. 1, a printer 1 is a horizontal direct tandem type color laser printer. The printer 1 includes a main casing 2 and, within the main casing 2, a feeding unit 3 for feeding sheets of paper P to be printed, an image-forming unit 4 for forming images on the sheets of paper P conveyed from the feeding unit 3, and an image-reading unit 5 for reading image data from original documents. Thus, the printer 1 is a multifunction peripheral that is integrally provided with the image-forming unit 4 and image-reading unit 5.

The main casing 2 has a box shape that is substantially rectangular in a side view. The feeding unit 3, image-forming unit 4, and image-reading unit 5 are accommodated in the main casing 2. A front cover 6 is provided on one side wall of the main casing 2 for exposing the inside of the main casing 2 in order to mount or remove a process unit 16 described later.

In the following description, the side of the printer 1 on which the front cover 6 is provided (right side in FIG. 1) will be referred to as the front side, and the opposite side (left side in FIG. 1) as the rear side. The left and right sides of the printer 1 will be based on the perspective of a user viewing the printer 1 from the front. Hence, the near side of the printer 1 in FIG. 1 is the left side, and the far side is the right side.

The feeding unit 3 includes a paper feed tray 7 for accommodating sheets of paper P. The paper feed tray 7 is detachably mounted in the bottom section of the main casing 2.

The paper P placed in the topmost position in the paper feed tray 7 by various rollers is supplied to the opposing part of the both registration rollers 13 and, after passing between the both registration rollers 13, is conveyed to a position between a photosensitive drum 21 (described later) and a conveying belt 34 (described later).

The image-forming unit 4 includes a scanning unit 15, a process unit 16, a transfer unit 17, and a fixing unit 18.

The scanning unit 15 is disposed in the top section of the main casing 2. As indicated by dotted lines in FIG. 1, the scanning unit 15 irradiates laser beams toward the four photosensitive drums 21 described later based on image data in order to expose the photosensitive drums 21.

The process unit 16 is disposed below the scanning unit 15 and above the transfer unit 17. The process unit 16 includes a single process frame 19, and four developer cartridges 20 provided respectively for each of the four colors.

The process frame 19 can be slid into or out of the main casing 2 in the front-to-rear direction and, thus, can be detachably mounted in the main casing 2. The process frame 19 retains photosensitive drums 21, Scorotron chargers 22, and drum-cleaning rollers 23.

Four of the photosensitive drums 21 are arranged parallel to one another and oriented with their axes along the left-to-right direction, and are juxtaposed in the left-to-right direction. Specifically, the photosensitive drums 21 include a black photosensitive drum 21K, a yellow photosensitive drum 21Y, a magenta photosensitive drum 21M, and a cyan photosensitive drum 21C arranged in this order from front to back.

The Scorotron chargers 22 are disposed diagonally above and rearward of the respective photosensitive drums 21 and confront but do not contact the photosensitive drums 21.

The drum-cleaning rollers 23 are disposed to the rear of the respective photosensitive drums 21 and confront and contact the photosensitive drums 21.

The developer cartridges 20 are detachably mounted in the process frame 19 in a juxtaposed state above the corresponding photosensitive drums 21 and confront the corresponding photosensitive drums 21. Specifically, the developer cartridges 20 include a black developing unit 20K, a yellow developing unit 20Y, a magenta developing unit 20M, and a cyan developing unit 20C arranged in this order from front to rear. Each of the developer cartridges 20 is also provided with a developing roller 26.

Each developing unit 20 includes a developing section 24 and a toner cartridge 25. The developing section 24 includes a developing roller 26, a supply roller 27 for supplying the developing roller 26 with toner, and a layer-thickness regulating blade 28 for regulating thickness of toner supplied to the developing roller 26. An auger 29 is provided in a space above those parts for conveying toner in the left-right direction. The developing section 24 is formed with a developing-section-side toner supply port 45.

Each developing roller 26 is rotatably supported in the lower end of the corresponding developing section 24. The bottom rear edge of the developing roller 26 is exposed through the lower edge of the developing unit 20 and contacts the corresponding photosensitive drum 21 from the top thereof. The toner supply port 45 penetrates in an up-down direction in the upper end of the corresponding developing section 24.

The toner cartridge 25 is formed in a substantially cylindrical shape of which the both ends in the left-right direction are closed. The toner cartridge 25 accommodates toner corresponding to each color. The toner cartridge 25 is formed with a cartridge-side toner supply port 30.

The cartridge-side toner supply port 30 is formed in the up-down direction to penetrate through the lower end of the toner cartridge 25, so as to oppose the developing-section-side toner supply port 45 of the developing section 24.

Toner accommodated in each toner cartridge 25 is supplied to the developing section 24 via the cartridge-side toner supply port 30 and the developing section-side toner supply port 45. The auger 29 conveys in the right-to-left direction toner and supplies the toner onto the corresponding supply roller 27, in turn the toner is supplied to the developing roller 26. At this time, the toner is positively turbo-charged between the supply roller 27 and developing roller 26.

As the developing roller 26 rotates, the thickness-regulating blade 28 regulates the toner carried on the surface of the developing roller 26 to a prescribed thickness, so that the developing roller 26 carries a uniform thin layer of toner thereon.

In the meantime, the Scorotron charger 22 applies a uniform charge of positive polarity to the surface of the corresponding photosensitive drum 21 while the photosensitive drum 21 rotates. Subsequently, the scanning unit 15 irradiates a laser beam (indicated by a dotted line in FIG. 1) in a high-speed scan in order to form an electrostatic latent image on the surface of the respective photosensitive drum 21 based on image data for a respective color corresponding to an image to be formed on a sheet of paper P.

As the photosensitive drum 21 continues to rotate, the positively charged toner carried on the surface of the developing roller 26 is supplied to the electrostatic latent image formed on the surface of the photosensitive drum 21, thereby developing the electrostatic latent image into a visible toner image through reverse development.

The transfer unit 17 is disposed in the main casing 2 above the feeding unit 3 and below the process unit 16 and extends in the front-to-rear direction. The transfer unit 17 includes a drive roller 32, a follow roller 33, a conveying belt 34, and four transfer rollers 35.

The drive roller 32 and follow roller 33 are disposed parallel to each other and are separated in the front-to-rear direction. The conveying belt 34 is mounted around the drive roller 32 and follow roller 33, with the top portion of the conveying belt 34 opposing and contacting each of the photosensitive drums 21 from below. When the drive roller 32 is driven to rotate, the conveying belt 34 circulates in a counterclockwise when viewed from the left side so that the top portion of the conveying belt 34 in contact with the photosensitive drums 21 moves rearward for conveying a sheet of paper P rearward.

The transfer rollers 35 are disposed inside the conveying belt 34 at positions opposing corresponding photosensitive drums 21, with the top portion of the conveying belt 34 interposed therebetween. The positions between the transfer rollers 35 and respective photosensitive drums 21 will be referred to as transfer positions.

When a sheet of paper P is supplied from the feeding unit 3, the conveying belt 34 conveys the sheet rearward so that the sheet passes sequentially through each transfer position between the photosensitive drums 21 and corresponding transfer rollers 35. As the sheet is conveyed on the conveying belt 34, toner images in each color carried on the respective photosensitive drums 21 are sequentially transferred onto the sheet to form a color image.

In some cases, residual toner remains on the peripheral surfaces of the photosensitive drums 21 after the toner images have been transferred onto the paper P. Therefore, when the residual waste toner is brought opposite the drum-cleaning roller 23 by the rotation of the photosensitive drum 21, the waste toner is transferred onto the peripheral surface of the drum-cleaning roller 23 owing to a cleaning bias applied to the drum-cleaning roller 23 and is temporarily retained on the drum-cleaning roller 23.

The fixing unit 18 is disposed to the rear of the transfer unit 17 and includes a heating roller 36, and a pressure roller 37 in confrontation with the heating roller 36. After a color image has been transferred onto the sheet of paper P in the transfer unit 17, the image is fixed to the sheet by a combination of heat and pressure as the sheet passes between the heating roller 36 and pressure roller 37 in the fixing unit 18.

After the toner image has been fixed to the paper P, the sheet is conveyed along a U-shaped discharge path 38 toward a pair of discharge rollers 39 disposed at the downstream end of the path 38. The discharge rollers 39 discharge the sheet onto a discharge tray 40 formed on the top of the scanning unit 15.

Figure 2:
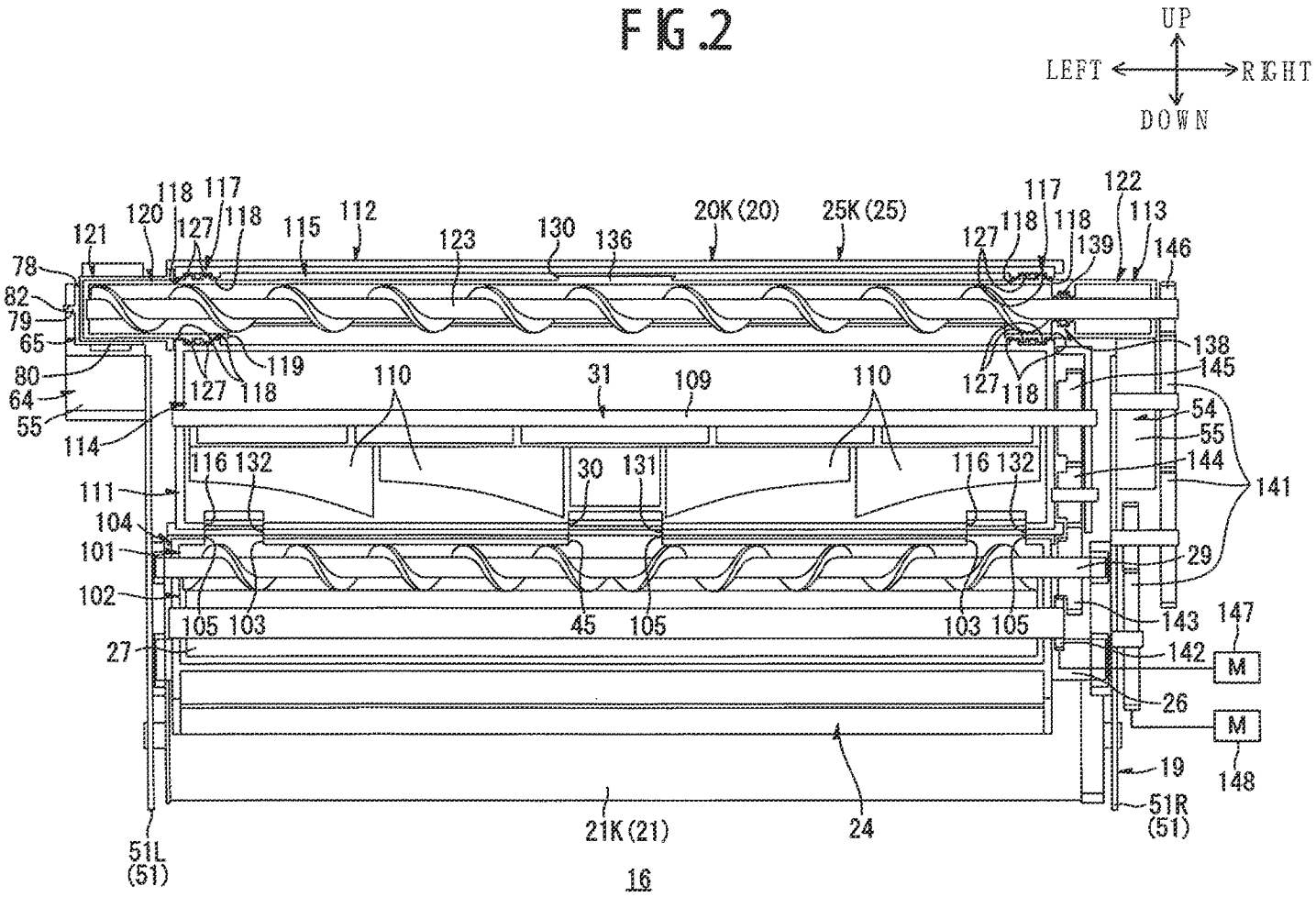
FIG. 2 is a cross-sectional view of a process unit of an image forming unit of the image forming device taken along the line II-II indicated in FIG. 1.
Figure 5:
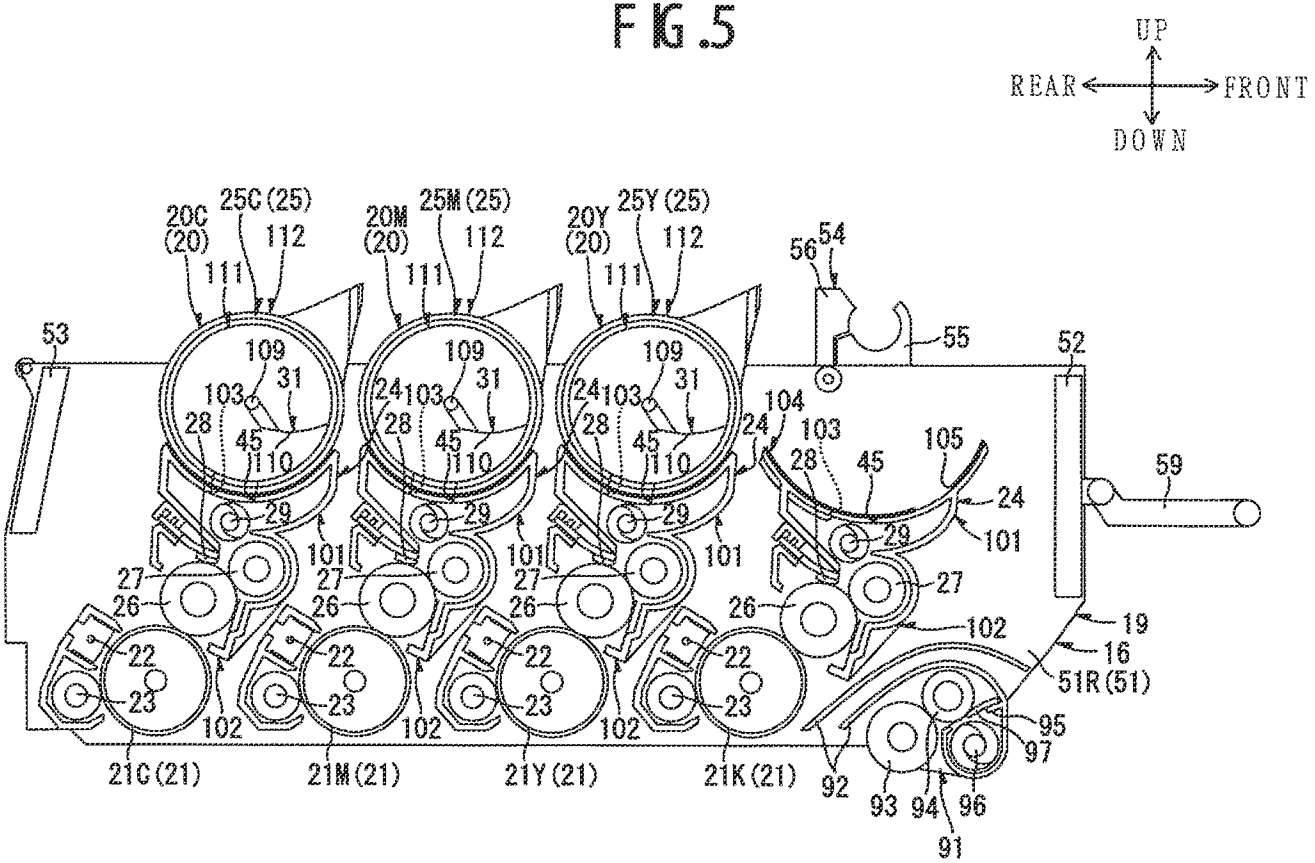
FIG. 5 is a cross-sectional view of the process unit when a receiving unit provided on the image forming unit is in a close position.

As shown in FIGS. 2 and 5, the process frame 19 includes a front beam 52, a rear beam 53, and a pair of side plates 51 positioned parallel to one another and on opposite sides of the front beam 52 and rear beam 53 so as to be separated from each other in the left-to-right direction.

The side plates 51 are also plate-shaped and substantially rectangular in a side view. The side plates 51 are elongated in the front-to-rear direction and function to rotatably support both axial ends of the photosensitive drums 21. Hereinafter, the side plate 51 on the left side will be referred to as the left side plate 51L, and the side plate 51 on the right side will be referred to as the right side plate 51R when it is necessary to distinguish between the two. A support section 54 is provided at the left side (an outer side in the left-right direction) of front end portion of the right side plate 51R (at outside in the right-to-left direction).

The support section 54 is formed in a substantially rectangular shape in a side view. The support section 54 includes a receiving member 55 and a holding member 56. The receiving member 55 is formed in a substantially rectangular shape in a side view. The receiving member 55 is formed in a substantially C-shape in a side cross-sectional view, where its upper end is notched downward from the upper end edge and opens obliquely toward the rear upper so as to be formed along the outer circumferential surface of a supported section 122 (described later) of a waste-toner conveying pipe 113 (described later). The receiving member 55 receives the right end of the supported section 122 (described later) of the waste-toner conveying pipe 113 (described later) (see FIG. 2).

The holding member 56 extends in the up-down direction, and is formed in a substantially L-shape in a side view, where its upper part protrudes frontward slightly. The holding member 56 is rotatably supported at the lower end by the right side plate 51R. The holding member 56 is normally erected so as to contact the rear end of the receiving member 55 from the rear by the urging force of a coil spring (not shown) (see FIG. 5). The holding member 56 is configured to slant rearward with its lower end as the fulcrum, against the urging force of the coil spring (not shown).

The front beam 52 is formed in a flat plate in a substantially rectangular shape, in a front view, extending in the left-right direction. A frame grip section 59 is provided on the front side of the front beam 52 so as to be capable of folding and erecting. The frame grip section 59 allows gripping by a user when the process frame 19 is mounted to or dismounted from the main casing 2. The rear beam 53 is formed in a flat plate in a substantially rectangular shape, in a front view, extending in the left-right direction.

Figure 3:
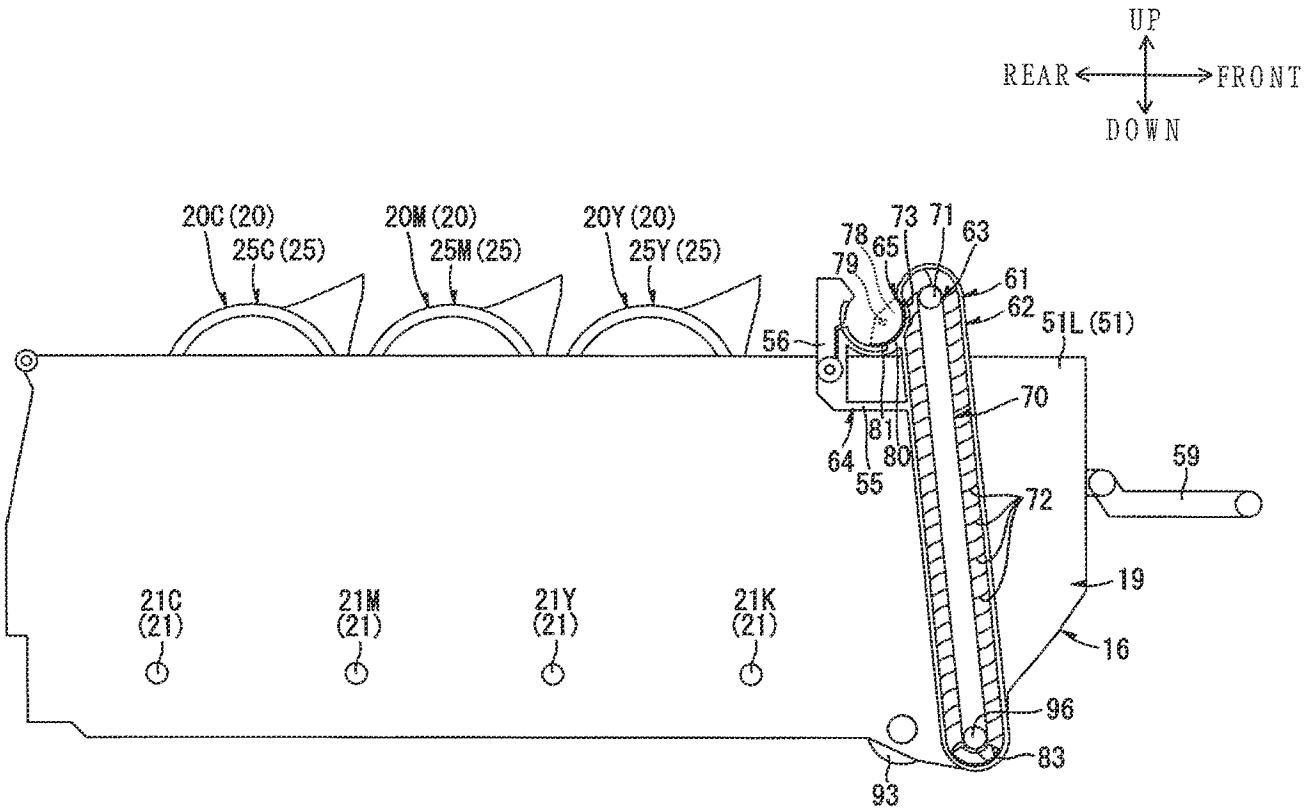
FIG. 3 is a side view illustrating the process unit when a waste-developer collecting unit provided on the image forming unit is in a close position.
Figure 4:
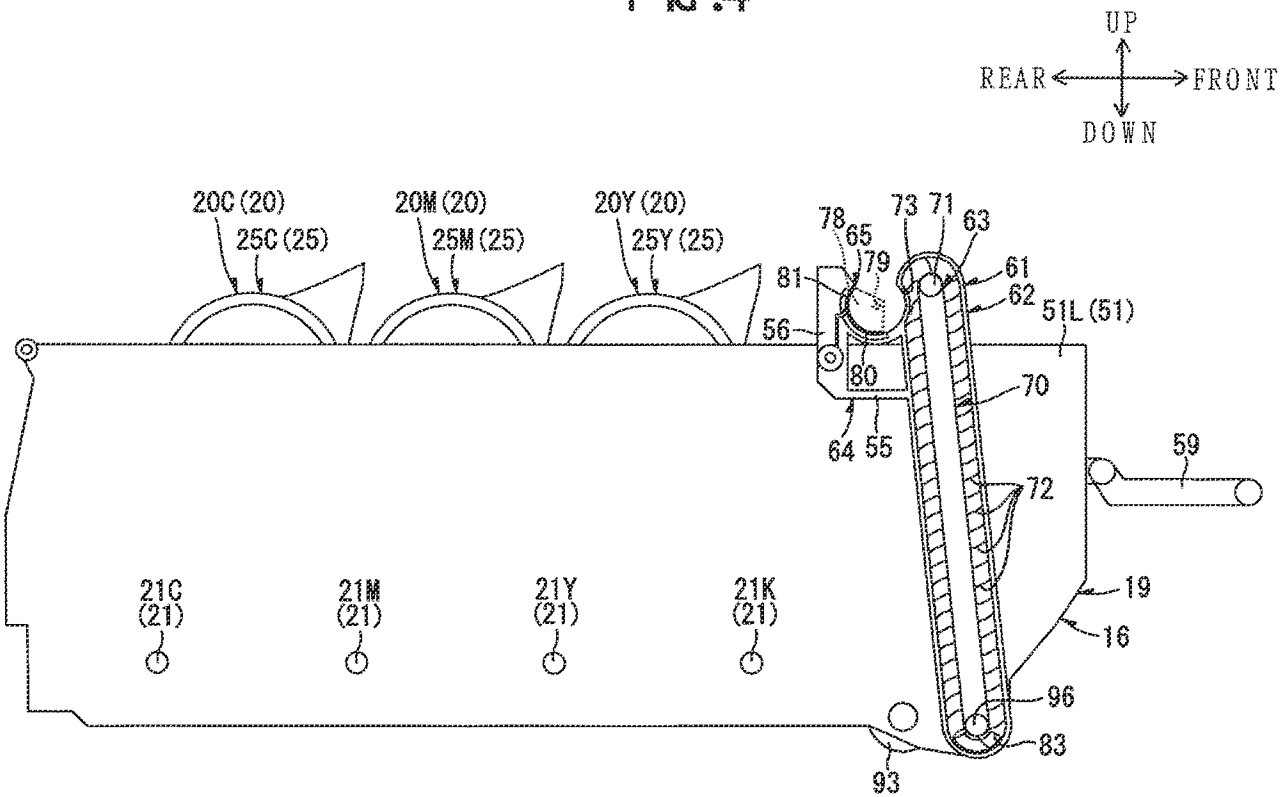
FIG. 4 is a side view illustrating the process unit when the waste-developer collecting unit is in an open position.

As shown in FIGS. 3 and 4, the process unit 16 includes a lift 61 that conveys waste toner upward.

The lift 61 is fixed to the left side plate 51L at the left side (an outer side in the left-right direction) of the front end of the left side plate 51L. The lift 61 extends in the up-down direction so as to slant rearward toward its upper end. The lift 61 includes a lift frame 62, a belt conveyer 63, a lift-side relay section 64, and a lift-side shutter 65.

The lift frame 62 extends in the up-down direction, and is formed in a substantially squared tube shape, in a side view, of which both of the upper and lower ends are curved. A lift-side communication port 73 is formed to penetrate, in the front-rear direction, through the upper end of the rear wall of the lift frame 62. The belt conveyer 63 is disposed within the lift frame 62, and includes a belt member 70 and a belt shaft 71.

The belt member 70 is formed in an endless shape from elastic material such as rubber. The belt member 70 includes multiple protrusions 72 each extending outward from its outer circumferential surface.

The protrusions 72 extends in left-right and up-down directions perpendicular to the circumferential direction of the belt member 70, and are provided at regular intervals all over the outer circumferential surface of the belt member 70. Each protrusion 72 protrudes to contact the inner circumferential surface of the lift frame 62 from inside. The belt shaft 71 is provided at the upper end within the lift frame 62 and extends in the left-right direction.

The left end of a waste-toner storage section 95 (described later) is connected, from the right, to the lower end of the lift 61. A waste-toner passing port 83 is formed for allowing communication in the left-right direction between the lower end of the lift 61 and the waste-toner storage section 95 (described later). The left end of a first screw 96 (described later) is rotatably supported at the lower end of the lift 61.

The waste-toner passing port 83 is located at the lower side of the left end of the first screw 96 (described later) in a left side view, and is formed along the lower wall of the lift frame 62. The belt member 70 is looped around the belt shaft 71 and the left end the first screw 96 (described later).

The lift-side relay section 64 is provided integrally with the lift 61 at the rear of the upper end of the lift 61. The lift-side relay section 64 is formed in a shape substantially similar to the shape of the support section 54, and includes the receiving member 55 and the holding member 56 similar to the support section 54.

The receiving member 55 receives the left end of a conveying-pipe-side relay section 120 (described later) of the waste-toner conveying pipe 113 (described later) (see FIG. 2). A shutter support hole 82 is formed in the lift-side relay section 64 to penetrate through the left side wall of the lift-side relay section 64 in the left-right direction, so as to receive a support boss 79 (described later) of the lift-side shutter 65 (see FIG. 2).

As shown in FIG. 2, the lift-side shutter 65 is formed in a partially cylindrical shape and is substantially fan-shaped in a side view. Specifically, the lift-side shutter 65 is integrally provided with a support part 78 that is substantially fan-shaped in a side view, with a center angle of approximately 120 degrees, the support boss 79 that protrudes leftward from the center point of the center angle formed by the support part 78, and a cover part 80 extending rightward from the arc-shaped edge of the support part 78. A fitting hole 81 is formed in the front edge of the cover part 80 near the support part 78. The fitting hole 81 extends in the left-to-right direction and receives a fitting protrusion 129 of a conveying-pipe side shutter 121 described later.

The lift-side shutter 65 is accommodated in the lift-side relaying part 64 such that the support boss 79 is rotatably inserted in the shutter support hole 82 and the outer surface of the cover part 80 confronts the inner surface of the lift-side relaying part 64. With this configuration, the lift-side shutter 65 can pivot about the support boss 79 between a closed position shown in FIG. 3 in which the cover part 80 confronts the lift-side communication port 73 in the front-to-rear direction, and an open position shown in FIG. 4 in which the cover part 80 is disposed below the lift-side communication port 73.

As shown in FIG. 5, the process unit 16 includes, at its front-lower end, a belt cleaner 91 for removing waste toner remaining on the surface of the conveying belt 34 and a paper guide 92.

The belt cleaner 91 includes a belt cleaning roller 93, a relay roller 94, the waste-toner storage section 95, the first screw 96, and a scraper 97. The belt cleaning roller 93 is exposed at its lower end, so as to contact the conveying belt 34 from the upper side. The relay roller 94 contacts the belt cleaning roller 93 obliquely from the front upper side. The waste-toner storage section 95 is provided, at the lower side of the relay roller 94, in a substantially cylindrical shape extending in the left-right direction and having an opening at its upper part. The first screw 96 is rotatably provided in the left-right direction within the waste-toner storage section 95. The scraper 97 is provided at the front upper end of the waste-toner storage section 95 so as to contact the lower end of the relay roller 94 from the lower side.

The paper guide 92 is provided at the lower part of the front end of the process frame 19. The paper guide 92 is formed to curve in a substantially V-shape opened downward in a side view, so as to cover the belt cleaner 91 from the upper side. The paper guide 92 guides paper P to pass the upper side of the belt cleaner 91 and to reach the conveying belt 34 at the rear of the belt cleaning roller 93 (see FIG. 1).

As shown in FIGS. 2 and 5, the developing section 24 includes a toner storing chamber 101 and a toner supplying chamber 102.

The toner storing chamber 101 is formed in a substantially rectangular shape extending in the front-rear direction in a side cross-sectional view, and forms the upper half part of the developing section 24. The lower end of the toner storing chamber 101 is in communication with the toner supplying chamber 102.

The upper end of the toner storing chamber 101 is formed in a substantially circular arc shape opened upward in a side view, so as to follow the outer circumferential surface of the corresponding toner cartridge 25. The upper end of the toner storing chamber 101 is configured so as to be capable of receiving the toner cartridge 25. The upper end of the toner storing chamber 101 is formed with the developing-section-side toner supply port 45, and with developing-section-side toner recovery ports 103. A developing-section-side shutter 104 is provided at the upper end of the toner storing chamber 101.

The developing-section-side toner supply port 45 is formed to penetrate, in the up-down direction, through the upper wall of the toner storing chamber 101. The developing-section-side toner supply port 45 is formed at a substantial center of the toner storing chamber 101 in the front-rear direction and in the left-right direction.

The developing-section-side toner recovery ports 103 are formed to penetrate, in the up-down direction, through the upper wall of the toner storing chamber 101. The developing-section-side toner recovery ports 103 are arranged at the left and right ends (one at each end) of the toner storing chamber 101 at a substantial center of the toner storing chamber 101 in the front-rear direction.

The developing-section-side shutter 104 is formed in a plate in a substantially circular arc shape opened upward in a side view, so as to follow the outer circumferential surface of the corresponding toner cartridge 25.

The front end of the developing-section-side shutter 104 is formed with three through-holes 105 each extending in the left-right direction at positions corresponding to the developing-section-side toner supply port 45 and the developing-section-side toner recovery ports 103. A fitting hole (not shown) is formed in the developing-section-side shutter 104 at the rear of each through-hole 105. The fitting hole (not shown) is for receiving a fitting protrusion 133 (described later) of a cartridge-side shutter 112 (described later).

The developing-section-side shutter 104 is supported at the upper end of the toner storing chamber 101 so as to be slidable in the front-rear direction. The developing-section-side shutter 104 is movable between: a close position at which the developing-section-side shutter 104 closes the developing-section-side toner supply port 45 and each developing-section-side toner recovery port 103 (see FIG. 5); and an open position at which the developing-section-side shutter 104 is slid rearward from the close position to open the developing-section-side toner supply port 45 and each developing-section-side toner recovery port 103 (see FIG. 11).

When the developing-section-side shutter 104 is at the close position, the through-holes 105 are located at the front of the developing-section-side toner supply port 45 and the developing-section-side toner recovery ports 103. At this position, the developing-section-side toner supply port 45 and the developing-section-side toner recovery ports 103 are closed by the center part of the developing-section-side shutter 104 in the front-rear direction.

When the developing-section-side shutter 104 is at the open position, the through-holes 105 are located to oppose the developing-section-side toner supply port 45 and the developing-section-side toner recovery ports 103. At this position, the developing-section-side toner supply port 45 and the developing-section-side toner recovery ports 103 are opened.

An auger 29 is disposed within the toner storing chamber 101. The auger 29 is rotatably provided at the lower side of the developing-section-side toner supply port 45 and the developing-section-side toner recovery ports 103, so as to extend in the left-right direction. The auger 29 is formed such that the right half is a left-hand helix and that the left half is a right-hand helix. The center part of the auger 29 opposes the developing-section-side toner supply port 45. The both ends of the auger 29 in the left-right direction oppose the respective ones of the developing-section-side toner recovery ports 103.

The auger 29 is rotatably supported by the developing section 24 at the both ends of its rotational axis in the left-right direction, so as to penetrate through the left and right side walls of the developing section 24 and to protrude toward both side plates 51 of the process frame 19.

The toner supplying chamber 102 is formed at the lower side continuously from the toner storing chamber 101, and forms the lower half of the developing section 24. As described earlier, the supply roller 27, the developing roller 26, and the layer-thickness regulating blade 28 are provided within the toner supplying chamber 102. The supply roller 27 is located to confront the auger 29 at a small distance in the up-down direction. The developing roller 26 contacts the supply roller 27 obliquely from the rear lower side. The layer-thickness regulating blade 28 contacts the developing roller 26 from the upper side.

The developing roller 26 is rotatably supported by the developing section 24 at the both ends of its rotational axis in the left-right direction, so as to penetrate through the left and right side walls of the developing section 24 and to protrude toward the both side plates 51 of the process frame 19.

The left and right ends of the auger 29 and the developing roller 26 (the portions protruding from the left and right side walls of the developing section 24) are supported so as to be movable in the up-down direction and to be rotatable relative to the both side plates 51 of the process frame 19.

With this arrangement, the developing section 24 is held by the process frame 19 so as to be movable in the up-down direction. The developing section 24 is pressed by urging means (not shown) so that the developing roller 26 is in pressure contact with the photosensitive drum 21.

The toner cartridges 25 include black toner cartridge 25K, yellow toner cartridge 25Y, magenta toner cartridge 25M, and cyan toner cartridge 25C for respective colors of toner.

Figure 6:
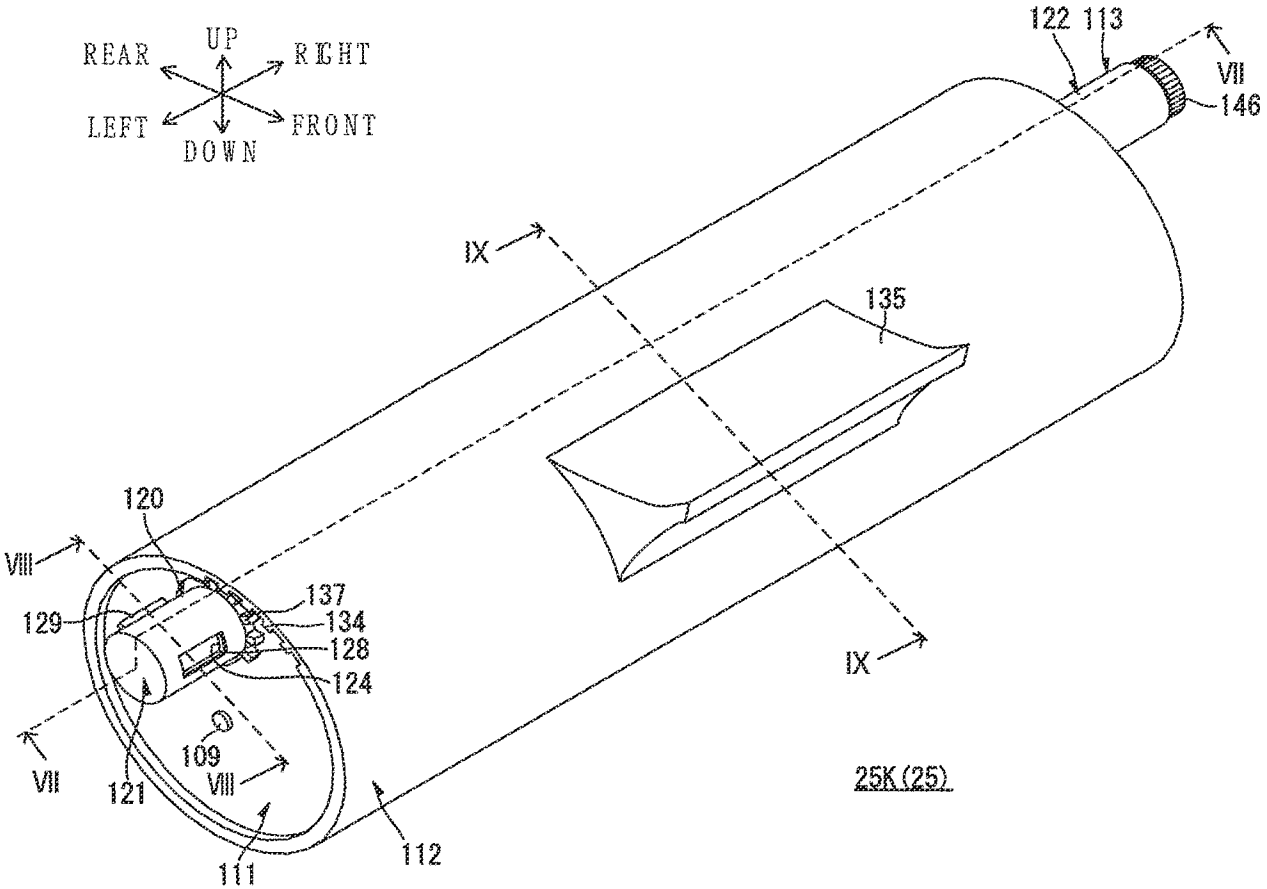
FIG. 6 is a perspective view of the developer container.

As shown in FIG. 6, the black toner cartridge 25K is formed in a substantially cylindrical shape extending in the left-right direction. The black toner cartridge 25K includes a frame 111, the cartridge-side shutter 112, and the waste-toner conveying pipe 113.

Figure 7:
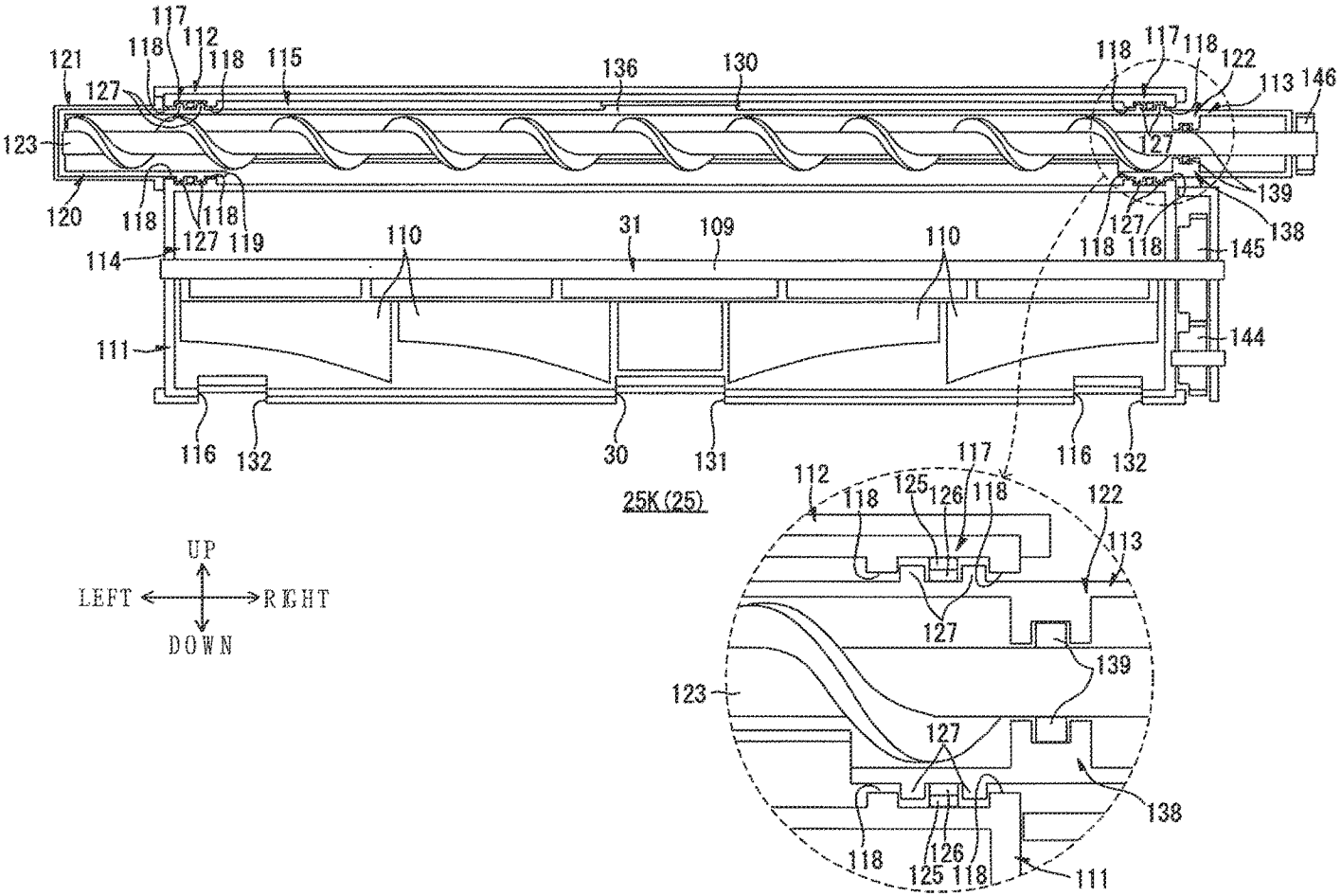
FIG. 7 is a cross-sectional view of the developer container taken along the line VII-VII indicated in FIG. 6.
Figure 9A:
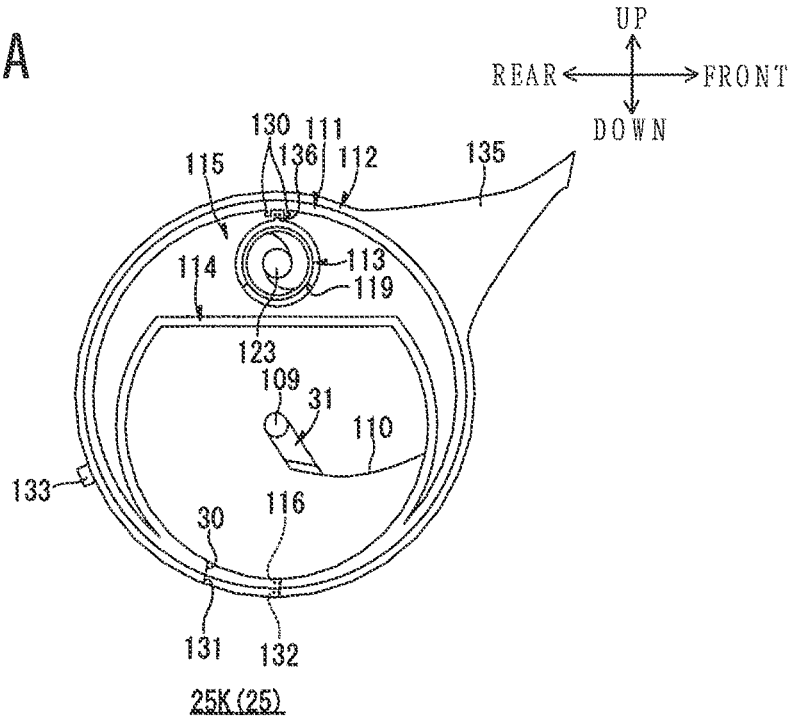
FIGS. 9A and 9B are cross-sectional views of the developer container taken along the line IX-IX indicated in FIG. 6 when the developer container is in an open position, and when the developer container is in a close position, respectively.

As shown in FIGS. 7 and 9A, the frame 111 is formed in a substantially cylindrical shape extending in the left-right direction (longitudinal direction) and having a closed left end and a closed right end in the left-right direction. The frame 111 includes a toner accommodating section 114 for accommodating toner therein at the lower part of the frame 111. The frame 111 also includes a waste-toner accommodating section 115 for accommodating waste toner therein at the upper side and at the front and rear sides of the toner accommodating section 114. Each of the toner accommodating section 114 and the waste-toner accommodating section 115 is a chamber formed in the frame 111.

That is, the frame 111 includes the toner accommodating section 114 and the waste-toner accommodating section 115 in an integrated manner, so that these sections cannot move relative to each other.

The toner accommodating section 114 is formed in a substantially cylindrical shape having a smaller diameter than the frame 111. Specifically, the upper end of the toner accommodating section 114 is truncated in a straight line in a side cross-sectional view to form a flat plate shape extending in the front-rear and left-right directions. The lower end of the toner accommodating section 114 shares an outer wall in the radial direction with the lower end of the frame 111.

The lower end of the toner accommodating section 114 is formed with the cartridge-side toner supply port 30 and with cartridge-side toner recovery ports 116. The cartridge-side toner supply port 30 provides fluid communication between the frame 111 and outside of the frame 111 to allow the toner to move from the toner accommodating section 114 to the outside of the frame 111. The toner accommodating section 114 includes an agitator 31.

The cartridge-side toner supply port 30 is formed to penetrate, in the up-down direction, through the lower wall of the toner accommodating section 114 (the lower wall of the frame 111). The cartridge-side toner supply port 30 is located at a substantial center of the lower end of the toner accommodating section 114 (the lower end of the frame 111) in the left-right direction, so as to oppose the developing-section-side toner supply port 45 in the up-down direction.

The cartridge-side toner recovery ports 116 are formed to penetrate, in the up-down direction, through the upper wall of the toner storing chamber 101. The cartridge-side toner recovery ports 116 are arranged at the left and right ends of the toner storing chamber 101, respectively (one at each end), at a substantial center of the toner storing chamber 101 in the front-rear direction, so as to oppose the developing-section-side toner recovery port 103 in the up-down direction.

The agitator 31 includes an agitator shaft 109 extending in the left-right direction and a plurality of (four) agitating blades 110 extending radially outwardly from the agitator shaft 109. The left and right ends of the agitator shaft 109 are rotatably supported by the side walls of the frame 111, thereby allowing the agitator 31 to be rotatable relative to the frame 111. By rotation, the agitator 31 conveys toner inward in the left-right direction, that is, from the both cartridge-side toner recovery ports 116 toward the cartridge-side toner supply port 30, while agitating toner.

The waste-toner accommodating section 115 is defined between the outer wall of the frame 111 and the outer wall of the toner accommodating section 114. More specifically, the waste-toner accommodating section 115 is formed in a substantially U-shape opened downward in a side cross-sectional view, so as to cover the toner accommodating section 114 from the upper side within the frame 111.

The waste-toner accommodating section 115 includes a pair of left and right conveying-pipe support sections 117 and a pair of front and rear frame-side engaging sections 130.

The conveying-pipe support sections 117 are provided at the left and right ends of the upper end, respectively (one at each end), within the waste-toner accommodating section 115, and are formed in cylindrical shapes. Conveying-pipe guide sections 118 are formed at each of the conveying-pipe support sections 117. Each of the conveying-pipe support sections 117 includes a support-section-side packing member 125.

The conveying-pipe guide sections 118 are a pair of left and right elongated protrusions formed over the entirety of the inner circumference of each conveying-pipe support section 117, so as to protrude radially inwardly from the inner circumferential surface of each conveying-pipe support section 117. The pair of conveying-pipe guide sections 118 is arranged to oppose each other with a space therebetween in the left-right direction larger than packing guide sections 127 (described later). Each conveying-pipe guide section 118 has an inner diameter that is slightly larger than the outer diameter of the waste-toner conveying pipe 113.

The support-section-side packing member 125 is made of elastic material such as sponge. The support-section-side packing member 125 is formed in a circular ring shape, in a side view, of which the inner diameter is substantially equal to the inner diameter of the conveying-pipe guide section 118, and the outer diameter is substantially equal to the inner diameter of the conveying-pipe support section 117. The support-section-side packing member 125 is disposed between the pair of conveying-pipe guide sections 118. The outer circumferential surface of the support-section-side packing member 125 is affixed to the inner circumferential surface of the conveying-pipe support section 117.

The both frame-side engaging sections 130 are elongated protrusions that protrude downward from the inner wall of the upper end of the frame 111, so as to extend in the left-right direction at the center part of the frame 111 in the left-right direction. The both frame-side engaging sections 130 are arranged to oppose each other with a space therebetween in the front-rear direction.

The cartridge-side shutter 112 is formed in a substantially cylindrical shape that covers the outer circumferential surface of the frame 111. The cartridge-side shutter 112 accommodates the frame 111 so that the cartridge-side shutter 112 can rotate relative to the frame 111. That is, the cartridge-side shutter 112 has an inner circumferential surface that is formed along the outer circumferential surface of the frame 111.

The length of the cartridge-side shutter 112 in the left-right direction is slightly larger than the length of the frame 111 in the same direction, so that the left and right ends of the cartridge-side shutter 112 protrude leftward and rightward, respectively, from the left and right ends of the frame 111. In addition, the left and right ends of the cartridge-side shutter 112 slightly protrude radially inwardly at the outer sides of the left and right ends of the frame 111, thereby restricting movement of the frame 111 in the left-right direction.

The cartridge-side shutter 112 is formed with a shutter-side toner supply port 131 and shutter-side toner recovery ports 132. The cartridge-side shutter 112 includes the fitting protrusion 133, a first gear section 134 (see FIG. 8A), and a grip 135.

The shutter-side toner supply port 131 is formed to penetrate through the circumferential wall of the cartridge-side shutter 112. The shutter-side toner supply port 131 is located at a substantial center of the cartridge-side shutter 112 in the left-right direction at a position corresponding to the cartridge-side toner supply port 30.

The shutter-side toner recovery ports 132 are formed to penetrate through the circumferential wall of the cartridge-side shutter 112. The shutter-side toner recovery ports 132 are arranged at the left and right ends (one at each end) of the cartridge-side shutter 112 at positions corresponding to the cartridge-side toner recovery ports 116.

The fitting protrusion 133 (FIG. 8A) is located rearward from the shutter-side toner supply port 131 and the shutter-side toner recovery ports 132. The fitting protrusion 133 is formed to protrude radially outwardly from the outer circumferential surface of the cartridge-side shutter 112.

Figure 8A:
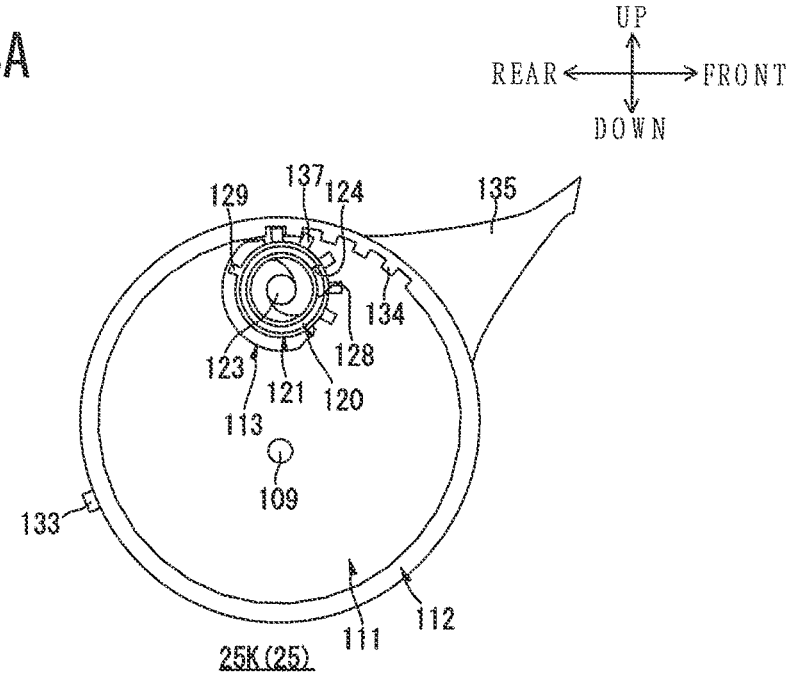
FIGS. 8A and 8B are cross-sectional views of the developer container taken along the line VIII-VIII indicated in FIG. 6 when the developer container is in an open position, and when the developer container is in a close position, respectively.

The first gear section 134 is formed on the inner circumferential surface of the left end of the cartridge-side shutter 112, at the outer side of the left end of the frame 111 (see FIG. 8A). The first gear section 134 is partially formed on the inner circumferential surface in a range of approximately 45 degrees clockwise, in a left side view, from the top end of the left end of the cartridge-side shutter 112 when the cartridge-side shutter 112 is at the open position (described later) (see FIG. 8A).

As shown in FIG. 6, the grip 135 is provided at a substantial center of the cartridge-side shutter 112 in the left-right direction, so as to protrude radially outwardly from a position on the outer circumferential surface of the cartridge-side shutter 112, the position being opposite from the fitting protrusion 133 (FIG. 8A).

Figure 9B:
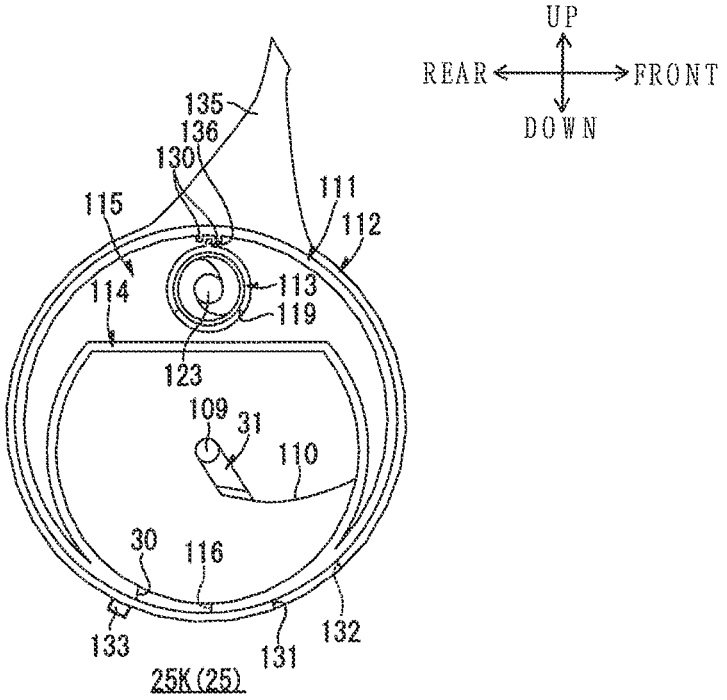

The cartridge-side shutter 112 is movable between: an open position at which the cartridge-side shutter 112 opens the shutter-side toner supply port 131 (see FIG. 9A); and a close position at which the cartridge-side shutter 112 is rotated from the open position counterclockwise in a left side view to close the shutter-side toner supply port 131 (see FIG. 9B).

When the cartridge-side shutter 112 is at the open position, the shutter-side toner supply port 131 opposes the cartridge-side toner supply port 30, and the both shutter-side toner recovery ports 132 oppose the both cartridge-side toner recovery ports 116 (see FIG. 9A).

When the cartridge-side shutter 112 is at the close position, the shutter-side toner supply port 131 is located frontward of the cartridge-side toner supply port 30, and the both shutter-side toner recovery ports 132 are located frontward of the both cartridge-side toner recovery ports 116, so that the cartridge-side toner supply port 30 and the both cartridge-side toner recovery ports 116 oppose the inner wall surface of the cartridge-side shutter 112 (see FIG. 9B).

As shown in FIG. 7, the waste-toner conveying pipe 113 is provided at the upper part at the center of the waste-toner accommodating section 115 in the front-rear direction, and is formed in a cylindrical shape extending in the left-right direction. The waste-toner conveying pipe 113 includes the conveying-pipe-side relay section 120 at the left end thereof, and the supported section 122 at the right end thereof. The waste-toner conveying pipe 113 is formed with an opening 119, between the conveying-pipe-side relay section 120 and the supported section 122. The opening 119 provides fluid communication between the inside of the waste-toner conveying pipe 113 and the waste-developer accommodating section 115 to allow the waste toner from the inside of the waste-toner conveying pipe 113 to the waste-developer accommodating section 115. Further, the waste-toner conveying pipe 113 includes a conveying-pipe-side engaging section 136 between the conveying-pipe-side relay section 120 and the supported section 122.

The conveying-pipe-side relay section 120 is provided at the left end of the waste-toner conveying pipe 113, at the left side of the opening 119. The conveying-pipe-side relay section 120 is formed with a conveying-pipe-side communication port 124 (see FIG. 8A). The conveying-pipe-side relay section 120 includes a conveying-pipe-side packing member 126, and the packing guide section 127.

As shown in FIG. 6, the conveying-pipe-side communication port 124 is formed at the front edge of the left end of the conveying-pipe-side relay section 120, so as to penetrate through the circumferential wall of the waste-toner conveying pipe 113 (see FIG. 8A). The conveying-pipe-side communication port 124 provides fluid communication between inside of the waste-toner conveying pipe 113 and outside of the waste-toner conveying pipe 113 to allow the waste toner to move from the outside of the waste-toner conveying pipe 113 to the inside of the waste-toner conveying pipe 113.

The conveying-pipe-side packing member 126 is made of elastic material such as sponge. As shown in FIG. 7, the conveying-pipe-side packing member 126 is formed in a circular ring shape, in a side view, of which the inner diameter is substantially equal to the outer diameter of the conveying-pipe-side relay section 120, and the outer diameter is substantially equal to the inner diameter of the conveying-pipe guide section 118.

As shown in FIG. 7, the packing guide sections 127 are a pair of left and right elongated protrusions formed at the right end of the conveying-pipe-side relay section 120 over the entirety of the outer circumference of the conveying-pipe-side relay section 120, so as to protrude radially outwardly from the outer circumferential surface of the conveying-pipe-side relay section 120. The outer diameter of each packing guide section 127 is substantially equal to the outer diameter of the conveying-pipe-side packing member 126. The both packing guide sections 127 are provided with a space therebetween in the left-right direction.

The conveying-pipe-side packing member 126 is fitted to the conveying-pipe-side relay section 120 so as to be fitted between the both packing guide sections 127, and is affixed to the outer circumferential surface of the conveying-pipe-side relay section 120.

The supported section 122 is provided at the right side of the opening 119, at the right end of the waste-toner conveying pipe 113. Like the conveying-pipe-side relay section 120, the supported section 122 includes the conveying-pipe-side packing member 126 and the packing guide sections 127 at the left end thereof. The conveying-pipe-side packing member 126 is fitted to the supported section 122 so as to be fitted between the both packing guide sections 127, and is affixed to the outer circumferential surface of the supported section 122. The supported section 122 includes a second screw support section 138.

The second screw support section 138 is located at the right side of the packing guide sections 127, and supports the right end of a second screw 123. Specifically, the second screw support section 138 is formed in a concave shape, in a front view, that extends radially inwardly from the inner circumferential surface of the supported section 122. The second screw support section 138 supports a bearing member 139 fitted to the right end of the outer surface of the second screw 123, so that the bearing member 139 can rotate relative to the second screw support section 138. The bearing member 139 also functions as a sealing member, for sealing the gap between the second screw 123 and the bearing member 139 and the gap between the second screw support section 138 and the bearing member 139.

The opening 119 is formed to cut out the lower end of the waste-toner conveying pipe 113 upward, so as to expose the inside of the waste-toner conveying pipe 113. The opening 119 is formed in a length that is slightly shorter than the distance between the both conveying-pipe support sections 117 of the waste-toner accommodating section 115.

The conveying-pipe-side engaging section 136 is an elongated protrusion protruding upward from the upper end of the waste-toner conveying pipe 113 at a substantial center of the waste-toner conveying pipe 113 in the left-right direction, and extending in the left-right direction. The conveying-pipe-side engaging section 136 is formed in a thickness that is slightly smaller than the space between the both frame-side engaging sections 130 in the front-rear direction.

The conveying-pipe-side engaging section 136 is engaged between the both frame-side engaging sections 130.

Note that the length of the waste-toner conveying pipe 113 in the left-right direction is longer than the length of the frame 111 in the left-right direction, so that the left and right ends of the waste-toner conveying pipe 113 (the conveying-pipe-side relay section 120 and the supported section 122, the both to be described later) are fitted to the lift-side relay section 64 and the support section 54 of the process frame 19.

The waste-toner conveying pipe 113 includes a conveying-pipe side shutter 121, and the second screw 123.

As shown in FIGS. 7 and 8A, the conveying-pipe side shutter 121 has an inner circumferential surface formed along the outer circumferential surface of the conveying-pipe-side relay section 120. The conveying-pipe side shutter 121 is formed in a substantially cylindrical shape opened at the right side and having a substantially squared C-shape in a cross section as viewed from the front (see FIG. 7). The conveying-pipe side shutter 121 is fitted to the outer side of the left end of the conveying-pipe-side relay section 120, so as to be rotatable relative to the conveying-pipe-side relay section 120.

The conveying-pipe side shutter 121 includes the fitting protrusion 129 and a second gear section 137. The conveying-pipe side shutter 121 is formed with a shutter-side communication port 128.

The fitting protrusion 129 (FIG. 8A) is an elongated protrusion extending in the left-right direction, and is formed to protrude radially outwardly from the outer circumferential surface of the conveying-pipe side shutter 121.

The second gear section 137 is formed to protrude radially outwardly at the right end of the conveying-pipe side shutter 121, so as to meshingly engage the first gear section 134 of the cartridge-side shutter 112. The second gear section 137 is partially formed on the conveying-pipe side shutter 121 in a range of approximately 120 degrees clockwise, in a left side view, from the top end of the right end of the conveying-pipe side shutter 121, when the conveying-pipe side shutter 121 is at the open position (described later) (see FIGS. 6 and 8(*a*)).

As shown in FIGS. 6 and 8A, the shutter-side communication port 128 is formed on the conveying-pipe side shutter 121 at a position that is substantially opposite from the fitting protrusion 129, so as to penetrate the conveying-pipe side shutter 121 in the front-rear direction.

Figure 8B:
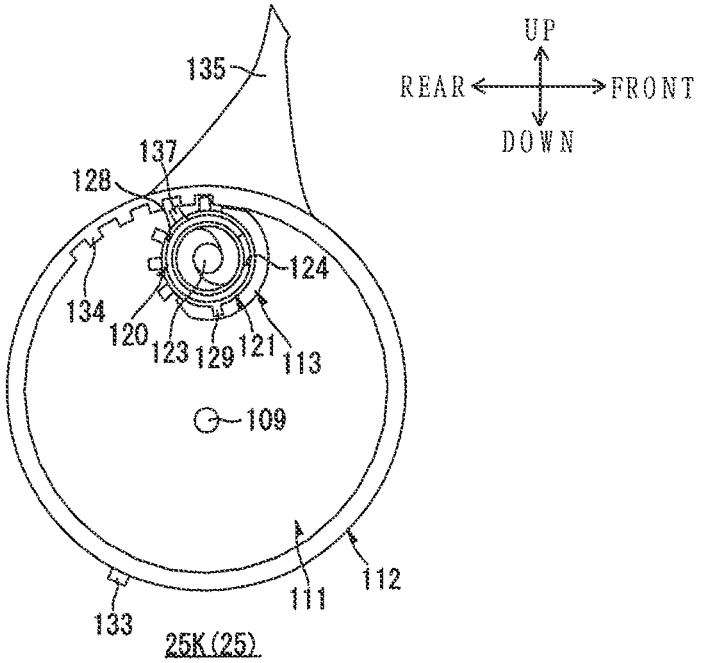

The conveying-pipe side shutter 121 can be rotated relative to the conveying-pipe-side relay section 120, thereby moving between: an open position for opening the conveying-pipe-side communication port 124 to allow communication between the conveying-pipe-side relay section 120 and the lift 61 (see FIG. 8A); and a close position for closing the conveying-pipe-side communication port 124 to block communication between the conveying-pipe-side relay section 120 and the lift 61 (see FIG. 8B).

When the conveying-pipe side shutter 121 is at the open position, the conveying-pipe-side communication port 124 and the shutter-side communication port 128 oppose each other in the front-rear direction. When the conveying-pipe side shutter 121 is at the close position, the conveying-pipe-side communication port 124 opposes the inner wall surface of the conveying-pipe side shutter 121. The second screw 123 is formed in a right-hand helix, and extends in the left-right direction within the waste-toner conveying pipe 113. The right end of the second screw 123 is supported by the bearing member 139, while the left end thereof is rotatably supported by the left end of the conveying-pipe-side relay section 120. By rotation, the second screw 123 conveys waste toner from the left to the right in left-to-right direction.

As shown in FIGS. 6 and 7, the waste-toner conveying pipe 113 is supported by the upper end of the waste-toner accommodating section 115, such that the conveying-pipe-side packing member 126 and the packing guide sections 127 of the conveying-pipe-side relay section 120 are fitted within the left-side conveying-pipe support section 117, and that the conveying-pipe-side packing member 126 and the packing guide sections 127 of the supported section 122 are fitted within the right-side conveying-pipe support section 117. With this arrangement, the waste-toner conveying pipe 113 is inserted in the waste-toner accommodating section 115 so as to extend in the left-right direction. Specifically, the waste-toner conveying pipe 113 is inserted through the frame 111 such that at least part of the waste-toner conveying pipe 113 is positioned in the waste-toner accommodating section 115.

The inner circumferential surface of the support-section-side packing member 125 is in close contact with the outer circumferential surface of the conveying-pipe-side packing member 126. The outer circumferential surfaces of the packing guide sections 127 oppose the inner circumferential surfaces of the conveying-pipe support sections 117 with small spaces therebetween. The outer circumferential surface of the waste-toner conveying pipe 113 opposes the inner circumferential surfaces of the conveying-pipe guide sections 118 with small spaces therebetween.

That is, the waste-toner conveying pipe 113 is loosely fitted to the frame 111 (the toner accommodating section 114 and the waste-toner accommodating section 115) so as to be movable relative to the frame 111. The both support-section-side packing member 125 and the both conveying-pipe-side packing member 126 support the waste-toner conveying pipe 113 at the left and right ends thereof (the conveying-pipe-side relay section 120 and the supported section 122), so that the waste-toner conveying pipe 113 can move relative to the frame 111 (the toner accommodating section 114 and the waste-toner accommodating section 115) in directions perpendicular to the left-right direction.

The conveying-pipe-side engaging section 136 is engaged between the both frame-side engaging sections 130. Hence, the waste-toner conveying pipe 113 and the frame 111 are engaged with each other, so as to be incapable of rotating relative to each other.

The first gear section 134 and the second gear section 137 are meshingly engaged with each other. With this arrangement, the first gear section 134 and the second gear section 137 constitute a connecting section that connects the cartridge-side shutter 112 and the conveying-pipe side shutter 121 in an interlocking manner.

The conveying-pipe-side relay section 120 of the waste-toner conveying pipe 113 is located leftward (the outer side in the left-right direction) of the left end of the frame 111. The supported section 122 of the waste-toner conveying pipe 113 is located rightward (the outer side in the left-right direction) of the right end of the frame 111.

As shown in FIG. 5, the color toner cartridges 25 (the yellow toner cartridge 25Y, the magenta toner cartridge 25M, and the cyan toner cartridge 25C) are formed in a structure similar to the black toner cartridge 25K, except that the waste-toner accommodating section 115 and the waste-toner conveying pipe 113 are not provided and that their diameters are smaller than the diameter of the black toner cartridge 25K.

Specifically, each of the color toner cartridges 25 includes the frame 111 and the cartridge-side shutter 112. The frame 111 is formed in a substantially cylindrical shape and only includes the toner accommodating section 114. The cartridge-side shutter 112 accommodates the frame 111.

As shown in FIG. 2, a supply roller gear 142 and an auger drive gear 143 are provided at the right side of the developing section 24 of the developing unit 20. The supply roller gear 142 is provided at the right end of the supply roller 27 so as to be incapable of rotating relative to the supply roller 27. The auger drive gear 143 is provided at the right end of the auger 29 so as to be incapable of rotating relative to the auger 29, and is meshingly engaged with the supply roller gear 142 from the upper side.

An agitator gear 145 and a relay gear 144 are provided at the right side of the frame 111. The agitator gear 145 is provided at the right end of the agitator 31 so as to be incapable of rotating relative to the agitator 31. The relay gear 144 is meshingly engaged with the agitator gear 145 from the lower side. The relay gear 144 is also meshingly engaged with the auger drive gear 143 from the upper side. A first motor 147 is provided at the main casing 2 for inputting driving force to the supply roller gear 142.

A vertically-arranged gear train 141 is provided at the right side plate 51R of the process frame 19. The gear train 141 includes three gears arranged in the up-down direction, the gears being meshingly engaged with each other so as to transmit driving force in the up-down direction. The uppermost gear of the gear train 141 is provided at the right side of the support section 54.

A second screw gear 146 is provided at the right end of the second screw 123 in the toner cartridge 25, so as to be incapable of rotating relative to the second screw 123. A second motor 148 is provided at the main casing 2 for inputting driving force to the lowermost gear of the gear train 141.

When the black toner cartridge 25K is dismounted from the process unit 16, as shown in FIGS. 8B and 9B, the cartridge-side shutter 112 and the conveying-pipe side shutter 121 are both located at the close position.

At this time, the second gear section 137 is engaged with the farthest downstream side of the first gear section 134 in the clockwise direction in a left side view. The grip 135 of the cartridge-side shutter 112 is erected upward. Both of the fitting protrusion 133 of the cartridge-side shutter 112 and the fitting protrusion 129 of the conveying-pipe side shutter 121 protrude downward.

Figure 10:
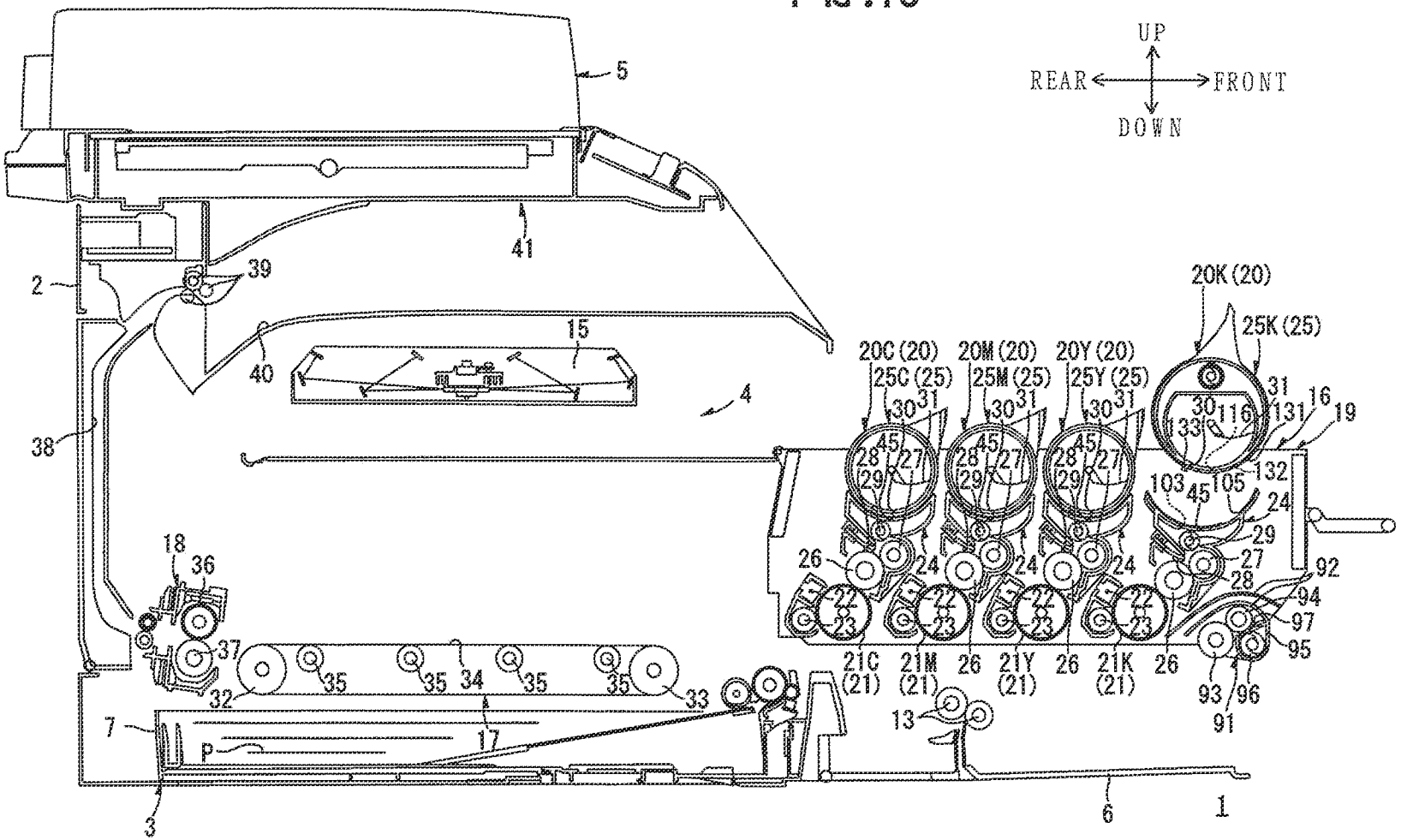
FIG. 10 is a cross-sectional view of the image forming device illustrating how the developer container is installed in the process unit.

As shown in FIG. 5, the developing-section-side shutter 104 of the developing section 24 is located at the close position for closing the developing-section-side toner recovery port 103. As shown in FIG. 3, the lift-side shutter 65 of the lift 61 is located at the close position for closing the lift-side communication port 73. In order to mount the black toner cartridge 25K onto the developing unit 20, as shown in FIG. 10, a user grips the grip 135 of the cartridge-side shutter 112 from the upper side so that the fitting protrusion 133 of the cartridge-side shutter 112 and the fitting protrusion 129 of the conveying-pipe side shutter 121 protrude downward.

Next, the user inserts the black toner cartridge 25K into the process unit 16 from the upper side, so that the black toner cartridge 25K is moved to the developing section 24 for black color of the process unit 16 drawn out of the main casing 2.

Then, the conveying-pipe-side relay section 120 and the supported section 122 of the waste-toner conveying pipe 113, that is, the left and right ends of the waste-toner conveying pipe 113 make contact with the upper end of the holding member 56 and the upper end of the receiving member 55 from the upper side, at the lift-side relay section 64 and the support section 54. Hence, the left and right ends of the waste-toner conveying pipe 113 are temporarily restricted from moving downward.

When the user further inserts the black toner cartridge 25K relative to the process unit 16, the left and right ends of the waste-toner conveying pipe 113 presses the lift-side relay section 64 and the holding member 56 of the support section 54 rearward against the urging force of a coil spring (not shown), so as to pressingly widen the space between the upper end of the holding member 56 and the upper end of the receiving member 55.

Then, the space between the upper end of the holding member 56 and the upper end of the receiving member 55 becomes wider than the diameter of the left and right ends of the waste-toner conveying pipe 113, thereby allowing the left and right ends of the waste-toner conveying pipe 113 to enter the space between the holding member 56 and the receiving member 55.

Then, the holding member 56 is erected due to the urging force of the coil spring (not shown), and the left and right ends of the waste-toner conveying pipe 113 is held between the holding member 56 and the receiving member 55. Hence, the waste-toner conveying pipe 113 is fixed in position, at the left and right ends thereof, relative to the process unit 16.

At the same time, the fitting protrusion 133 of the cartridge-side shutter 112 is fitted to a fitting hole (not shown) of the developing-section-side shutter 104 from the upper side, and the fitting protrusion 129 of the conveying-pipe side shutter 121 is fitted to a fitting hole 81 of the lift-side shutter 65 from the upper side.

With this operation, the cartridge-side shutter 112 and the developing-section-side shutter 104 are connected in an interlocking manner, and the conveying-pipe side shutter 121 and the lift-side shutter 65 are connected in an interlocking manner.

Further, the second screw gear 146 of the waste-toner conveying pipe 113 is meshingly engaged, from the upper side, with the uppermost gear of the gear train 141 of the process frame 19. Also, the relay gear 144 of the frame 111 is meshingly engaged with the auger drive gear 143 of the developing section 24 from the upper side.

Figure 11:
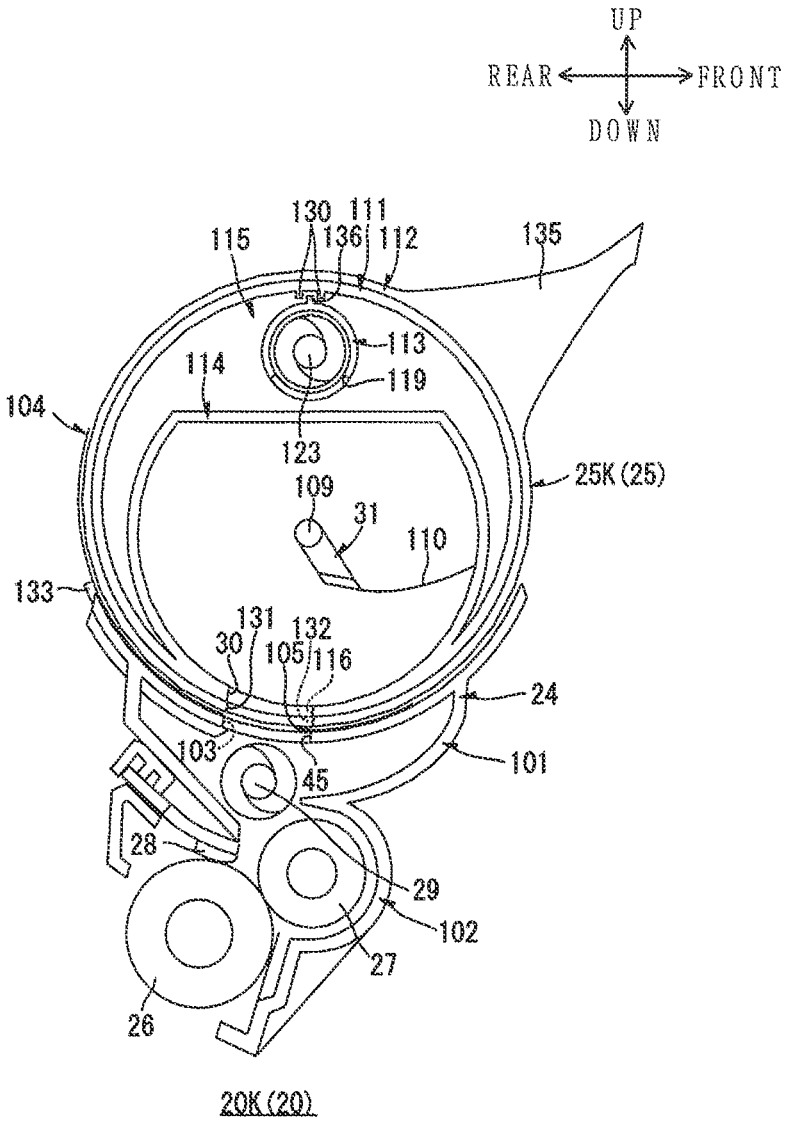
FIG. 11 is a cross-sectional view of the developer container and a developing section included in the process unit when the developer container is mounted in the developing section.

Next, the user grips the grip 135 of the cartridge-side shutter 112 to rotate the cartridge-side shutter 112 toward the front. Then, as shown in FIG. 11, the cartridge-side shutter 112 is rotated clockwise in a left side view, to be located at the open position. At the same time, the developing-section-side shutter 104 slides rearward to be located at the open position.

Hence, the cartridge-side toner supply port 30, the shutter-side toner supply port 131, the through-hole 105, and the developing-section-side toner supply port 45 oppose one another in the up-down direction, thereby allowing passage of toner from the toner accommodating section 114 to the developing section 24.

At the same time, the cartridge-side toner recovery ports 116, the shutter-side toner recovery ports 132, the through-holes 105, and the developing-section-side toner recovery ports 103 oppose one another in the up-down direction, thereby allowing passage of toner from the developing section 24 to the toner accommodating section 114.

When the cartridge-side shutter 112 rotates clockwise in a left side view, the first gear section 134 rotates clockwise in a left side view. At this time, clockwise driving force in a left side view is transmitted to the second gear section 137 engaged with the first gear section 134, so that the second gear section 137 rotates clockwise in a left side view.

Thus, by interlocking with the cartridge-side shutter 112, the conveying-pipe side shutter 121 rotates clockwise in a left side view to be located at the open position. That is, both of the cartridge-side shutter 112 and the conveying-pipe side shutter 121 are moved from the close position to the open position. At the same time, the lift-side shutter 65 slides rearward to be located at the open position.

Hence, the lift-side communication port 73, the shutter-side communication port 128, and the conveying-pipe-side communication port 124 overlap one another in the front-rear direction, thereby allowing passage of waste toner from the lift 61 to the waste-toner conveying pipe 113.

Note that, because the waste-toner conveying pipe 113 is fixed to the support section 54 at the supported section 122, the waste-toner conveying pipe 113 is fixed in position, without following rotation of the conveying-pipe side shutter 121. Similar to the waste-toner conveying pipe 113, because the frame 111 is engaged with the conveying-pipe-side engaging section 136 of the waste-toner conveying pipe 113 at the frame-side engaging section 130, the frame 111 is fixed in position, without following rotation of the cartridge-side shutter 112.

In order to dismount the black toner cartridge 25K from the developing unit 20, the user performs reversed operations of mounting the black toner cartridge 25K to the developing unit 20.

Specifically, the user grips the grip 135 of the cartridge-side shutter 112 to rotate the cartridge-side shutter 112 rearward, thereby moving the cartridge-side shutter 112, the conveying-pipe side shutter 121, and the lift-side shutter 65 from the open position to the close position.

Subsequently, the user draws the black toner cartridge 25K upward from the developing section 24 for black color of the process unit 16 to dismount the black toner cartridge 25K.

When the first motor 147 of the main casing 2 inputs driving force to the supply roller gear 142, the supply roller 27 is rotated. At the same time, the driving force is transmitted from the supply roller gear 142 to the auger drive gear 143 engaged with the supply roller gear 142, thereby rotating the auger 29.

At the same time, the driving force is transmitted from the auger drive gear 143, via the relay gear 144 engaged with the auger drive gear 143, to the agitator gear 145 engaged with the relay gear 144, thereby rotating the agitator 31.

When the second motor 148 of the main casing 2 inputs driving force to the lowermost gear of the gear train 141, the driving force is transmitted, via the gear train 141, to the second screw gear 146 engaged with the uppermost gear of the gear train 141, thereby rotating the second screw 123.

In an image forming operation by the color laser printer 1, the process unit 16 forms images as described above. During an image forming operation, by rotation of the agitator 31, toner within the toner accommodating section 114 is supplied from the cartridge-side toner supply port 30, via the through-hole 105 and the developing-section-side toner supply port 45, to the center part of the toner storing chamber 101 of the developing section 24 in the left-right direction.

By rotation of the auger 29, toner supplied to the toner storing chamber 101 is supplied to the supply roller 27, while being conveyed from the center part in the left-right direction toward the left and right ends. As described above, toner supplied to the supply roller 27 is supplied to the photosensitive drum 21 via the developing roller 26.

On the other hand, among toner that has been supplied to the toner storing chamber 101, some amount of toner is not supplied to the supply roller 27. Such toner is conveyed from the center part to the left and right ends by rotation of the auger 29, and is recovered to the left and right ends of the toner accommodating section 114 via the both developing-section-side toner recovery ports 103, the through-holes 105, and the both cartridge-side toner recovery ports 116.

Toner recovered to the toner accommodating section 114 is again conveyed to the center part in the left-right direction by rotation of the agitator 31, and is supplied to the developing section 24 via the cartridge-side toner supply port 30.

In order to recover waste toner, the drum cleaning roller 23 is applied with a reverse bias of a cleaning bias. Then, waste toner temporarily borne on the drum cleaning roller 23 is discharged from the drum cleaning roller 23 via the photosensitive drum 21 to the conveying belt 34.

Waste toner discharged to the conveying belt 34 moves below the conveying unit 17 by circular movement of the conveying belt 34 to reach a position opposing the belt cleaning roller 93.

Then, waste toner is captured by the belt cleaning roller 93 due to the cleaning bias applied to the belt cleaning roller 93, and is passed from the belt cleaning roller 93 to the relay roller 94, and is subsequently scraped by the scraper 97 to be stored within the waste-toner storage section 95.

Waste toner stored in the waste-toner storage section 95 is conveyed leftward by rotation of the first screw 96, passes through the waste-toner passing port 83, and is supplied to the lower end of the lift 61. Waste toner supplied to the lower end of the lift 61 is conveyed upward along the rear wall of the lift 61 by the belt conveyer 63, and is supplied to the conveying-pipe-side relay section 120 of the waste-toner conveying pipe 113 via the lift-side communication port 73, the shutter-side communication port 128, and the conveying-pipe-side communication port 124.

Waste toner supplied to the conveying-pipe-side relay section 120 is conveyed rightward by rotation of the second screw 123, passes through the opening 119, and is conveyed droppingly to the waste-toner accommodating section 115 to be accommodated therein. In this way, an operation for recovering waste toner is completed.

The photosensitive drum 21 rotates during the above-described image forming operation and waste-toner recovering operation. When the photosensitive drum 21 rotates, by rotation of the photosensitive drum 21, the developing roller 26 in contact with the photosensitive drum 21 is vibrated in directions perpendicular to the left-right direction. Vibrations of the developing roller 26 cause the developing section 24 to vibrate and, via the developing section 24, also cause the frame 111 of the black toner cartridge 25K to vibrate in directions perpendicular to the left-right direction.

At this time, in the conveying-pipe support sections 117 of the waste-toner accommodating section 115 in the black toner cartridge 25K, due to vibrations of the frame 111, the support-section-side packing member 125 and the conveying-pipe-side packing member 126 are compressed or expanded to absorb the vibrations.

This mechanism in the black toner cartridge 25K suppresses vibrations of the frame 111 from being transmitted to the waste-toner conveying pipe 113 which is fixed in position relative to the process unit 16.

Note that the support-section-side packing member 125 and the conveying-pipe-side packing member 126 are always in close contact with each other, even when being compressed or expanded.

(1) In the conventional toner cartridge, the toner discharging section is fitted in the recovery port, thereby allowing the toner cartridge to be fixed in position relative to the developing unit.

Hence, if vibrations occur due to driving of the photosensitive drum during an image forming operation, the vibrations may be transmitted to the toner discharging section fitted in the recovery port of the toner cartridge, causing the toner discharging section to be damaged or causing waste toner to leak through a gap between the recovery port and the toner discharging section.

In the color laser printer 1, as well, because the developing section 24 is held so as to be movable relative to the process frame 19, vibrations occur due to rotations of the photosensitive drum 21. The vibrations of the developing section 24 cause the black toner cartridge 25K to also vibrate.

However, according to the black toner cartridge 25K, as shown in FIG. 7, the toner accommodating section 114 and the waste-toner accommodating section 115 are provided integrally with the frame 111, and the waste-toner conveying pipe 113 accommodating the second screw 123 therein is provided so as to be movable relative to the frame 111 (the toner accommodating section 114 and the waste-toner accommodating section 115). Also, the support-section-side packing member 125 and the conveying-pipe-side packing member 126 support the waste-toner conveying pipe 113 so as to be movable in directions perpendicular to the left-right direction relative to the toner accommodating section 114 and the waste-toner accommodating section 115.

Hence, even if the waste-toner conveying pipe 113 is fixed in position relative to the color laser printer 1 when the black toner cartridge 25K is mounted on the color laser printer 1, the frame 111 (the toner accommodating section 114 and the waste-toner accommodating section 115) can be moved relative to the waste-toner conveying pipe 113 in directions perpendicular to the left-right direction.

Thus, even if the black toner cartridge 25K vibrates due to vibrations of the developing section 24, the frame 111 moves relative to the waste-toner conveying pipe 113, thereby preventing the vibrations from being transmitted to the waste-toner conveying pipe 113.

Consequently, the waste-toner conveying pipe 113 can be fixed in position and waste toner can be recovered reliably, while vibrations occurring during an image forming operation can be absorbed at the support-section-side packing member 125 and the conveying-pipe-side packing member 126, preventing the waste-toner conveying pipe 113 from being damaged and preventing waste toner from leaking from the waste-toner conveying pipe 113 (especially, the conveying-pipe-side relay section 120).

(2) According to the black toner cartridge 25K, as shown in FIGS. 6 and 7, the waste-toner conveying pipe 113 is inserted in the waste-toner accommodating section 115 to extend in the left-right direction. Hence, the waste-toner conveying pipe 113 can be disposed within the waste-toner accommodating section 115, thereby making the black toner cartridge 25K compact.

(3) According to the black toner cartridge 25K, as shown in FIG. 7, the support-section-side packing member 125 and the conveying-pipe-side packing member 126 support the waste-toner conveying pipe 113 at the both ends thereof in the left-right direction. Hence, the waste-toner conveying pipe 113 can be supported more reliably relative to the waste-toner accommodating section 115 at the both ends in the left-right direction, than when the waste-toner conveying pipe 113 is supported at only one of the left and right ends, thereby preventing the waste-toner conveying pipe 113 from being slanted relative to the frame 111.

(4) According to the black toner cartridge 25K, as shown in FIG. 7, the left and right ends of the waste-toner conveying pipe 113 are located farther outward in the left-right direction than the left and right ends of the waste-toner accommodating section 115. Hence, the waste-toner conveying pipe 113 can be fixed in position reliably at the left and right ends thereof, by the support section 54 and the lift-side relay section 64. Consequently, vibrations caused by rotations of the photosensitive drum 21 can be absorbed uniformly in the left-right direction. That is, errors (nonuniformity) in absorbing vibrations in the left-right direction can be prevented.

Here, for example, if the waste-toner conveying pipe 113 is fixed in position at one side of the left and right ends, absorption of vibrations may become nonuniform in the left-right direction. In this case, the state of pressure contact of the developing roller 26 against the photosensitive drum 21 may become nonuniform in the left-right direction, leading to nonuniform development.

However, according to the black toner cartridge 25K, since vibrations can be absorbed uniformly in the left-right direction, the state of pressure contact of the developing roller 26 against the photosensitive drum 21 can maintain uniform leading to uniform development.

(5) According to the black toner cartridge 25K, as shown in FIGS. 8A and 8B, the cartridge-side shutter 112 and the conveying-pipe side shutter 121 are connected in an interlocking manner by the connecting section (the first gear section 134 and the second gear section 137), so that the both are moved to the open position or the close position. Hence, the both of the cartridge-side shutter 112 and the conveying-pipe side shutter 121 can be moved to the open position or the close position in a single operation. Consequently, the both of the cartridge-side shutter 112 and the conveying-pipe side shutter 121 can be reliably moved to the open position or the close position in a simple operation.

(6) According to the black toner cartridge 25K, as shown in FIGS. 6 and 7, the frame 111 provided integrally with the toner accommodating section 114 and the waste-toner accommodating section 115 is formed in a cylindrical shape. The cartridge-side toner supply port 30 is formed to penetrate through the circumferential wall of the frame 111. The cartridge-side shutter 112 is formed in a cylindrical shape having an inner circumferential surface formed along the outer circumferential surface of the frame 111 and accommodating the frame 111 so that the frame 111 can rotate relative to the cartridge-side shutter 112. Hence, by rotating the cartridge-side shutter 112 relative to the frame 111, the cartridge-side shutter 112 can be moved to the open position or the close position. Thus, when the cartridge-side shutter 112 is located at the close position, the cartridge-side toner supply port 30 can be reliably closed by the inner circumferential surface of the cartridge-side shutter 112.

Additionally, the waste-toner conveying pipe 113 is formed in a cylindrical shape. The conveying-pipe-side communication port 124 is formed to penetrate through the circumferential wall of the waste-toner conveying pipe 113. The conveying-pipe side shutter 121 is formed in a cylindrical shape having an inner circumferential surface formed along the outer circumferential surface of the waste-toner conveying pipe 113 and fitted to the left end of the waste-toner conveying pipe 113 so as to be rotatable relative to the waste-toner conveying pipe 113.

Hence, by rotating the conveying-pipe side shutter 121 relative to the waste-toner conveying pipe 113, the conveying-pipe side shutter 121 can be moved to the open position or the close position. Thus, when the conveying-pipe side shutter 121 is located at the close position, the conveying-pipe-side communication port 124 can be reliably closed by the inner circumferential surface of the conveying-pipe side shutter 121.

(7) According to the black toner cartridge 25K, as shown in FIGS. 8A and 8B, the connecting section includes the first gear section 134 provided at the cartridge-side shutter 112, and the second gear section 137 provided at the conveying-pipe side shutter 121 and capable of engaging with the first gear section 134. Hence, by engaging the first gear section 134 with the second gear section 137, the cartridge-side shutter 112 and the conveying-pipe side shutter 121 can be moved reliably in an interlocking manner.

(8) According to the color laser printer 1, as shown in FIG. 1, in the black toner cartridge 25K, the toner accommodating section 114 and the waste-toner accommodating section 115 are provided integrally with the frame 111, the waste-toner conveying pipe 113 accommodating the second screw 123 is provided so as to be movable relative to the frame 111 (the toner accommodating section 114 and the waste-toner accommodating section 115). Further, the support-section-side packing member 125 and the conveying-pipe-side packing member 126 support the waste-toner conveying pipe 113 so that the waste-toner conveying pipe 113 can move in directions perpendicular to the left-right direction relative to the toner accommodating section 114 and the waste-toner accommodating section 115.

Hence, even if the waste-toner conveying pipe 113 is fixed in position relative to the color laser printer 1 when the black toner cartridge 25K is mounted on the color laser printer 1, the toner accommodating section 114 and the waste-toner accommodating section 115 can be moved relative to the waste-toner conveying pipe 113 in directions perpendicular to the left-right direction.

Consequently, the waste-toner conveying pipe 113 can be fixed in position and waste toner can be recovered reliably, while vibrations occurring during an image forming operation can be absorbed at the support-section-side packing member 125 and the conveying-pipe-side packing member 126.

(9) As shown in FIG. 5, the color laser printer 1 includes the developing-section-side shutter 104 that is movable between the open position for opening the developing-section-side toner supply port 45 to which toner is supplied from the cartridge-side toner supply port 30 and the close position for closing the developing-section-side toner supply port 45.

Hence, by first locating the developing-section-side shutter 104 at the close position and then, after the black toner cartridge 25K is mounted on the color laser printer 1, locating the developing-section-side shutter 104 at the open position, the black toner cartridge 25K can be mounted to or dismounted from the color laser printer 1 while preventing toner from leaking from the black toner cartridge 25K.

(10) As shown in FIGS. 3 and 4, the color laser printer 1 includes the lift-side shutter 65 that is movable between the open position for opening the lift-side communication port 73 for conveying waste toner to the conveying-pipe-side communication port 124, and the close position for closing the lift-side communication port 73.

Hence, by first locating the lift-side shutter 65 at the close position and then, after the black toner cartridge 25K is mounted on the color laser printer 1, locating the lift-side shutter 65 at the open position, the black toner cartridge 25K can be mounted to or dismounted from the color laser printer 1 while preventing waste toner from leaking through the lift-side communication port 73.

(11) Further, the color laser printer 1 includes the first motor 147 that inputs driving force to the agitator 31 for agitating toner in the black toner cartridge 25K, and the second motor 148 that inputs driving force to the second screw 123. Hence, even if the black toner cartridge 25K moves relative to the waste-toner conveying pipe 113, each of the agitator 31 and the second screw 123 can be driven reliably.

(12) As shown in FIG. 2, according to the color laser printer 1, the left and right ends of the waste-toner conveying pipe 113 are located farther outward in the left-right direction than the left and right ends of the waste-toner accommodating section 115, and are held by the support section 54 and the lift-side relay section 64. Hence, the waste-toner conveying pipe 113 can be held reliably and fixed in position by the support section 54 and the lift-side relay section 64.

While the invention has been described in detail with reference to the embodiment thereof, it would be apparent to those skilled in the art that various changes and modifications may be made therein without departing from the spirit of the invention.

In the above-described embodiment, only the black toner cartridge 25K among the toner cartridges 25 includes the waste-toner conveying pipe 113 and the waste-toner accommodating section 115, and the process unit 16 includes the belt cleaner 91 and the lift 61 connecting the belt cleaner 91 and the waste-toner conveying pipe 113.

In an operation of recovering waste toner, waste toner temporarily borne on the drum cleaning roller 23 sequentially passes the belt cleaner 91, the lift 61, and the waste-toner conveying pipe 113, and is recovered in the waste-toner accommodating section 115 of the black toner cartridge 25K.

However, it may be so configured that each toner cartridge 25 includes the waste-toner conveying pipe 113 and the waste-toner accommodating section 115, and that the process unit 16 does not include the belt cleaner 91 but includes the lift 61 connecting each drum cleaning roller and the waste-toner conveying pipe 113 of a corresponding toner cartridge 25.

According to this modification, waste toner is recovered from each drum cleaning roller, via the lift 61 and the waste-toner conveying pipe 113, to the waste-toner accommodating section 115 of a corresponding toner cartridge 25. In this modification, as well, the effects similar to those of the above-described embodiment can be obtained.

What is claimed is:

1. A toner cartridge detachably attachable to a developing section, the toner cartridge comprising:

a first frame having a first opening for providing communication of toner between inside of the first frame and outside of the first frame;

a first shutter movable between a first opening position where the first shutter opens the first opening and a first closing position where the first shutter closes the first opening;

a second frame having a second opening configured to provide communication of waste toner between inside of the second frame and outside of the second frame; and a second shutter movable between a second opening position where the second shutter opens the second opening and a second closing position where the second shutter closes the second opening, wherein the first frame with the first opening is movable relative to the second frame with the second opening when the toner cartridge is attached to the developing section.

2. The toner cartridge according claim 1, wherein the first frame has a toner accommodating chamber configured to accommodate toner and a waste-toner accommodating chamber configured to accommodate waste toner.

3. The toner cartridge according claim 2, wherein the second frame further has a third opening configured to provide fluid communication between an inside of the second frame and an inside of the waste-toner accommodating chamber.

4. The toner cartridge according claim 1, wherein the second frame is a waste-toner conveying pipe.

5. An image forming apparatus for use with a process unit and a toner cartridge detachably attachable to the process unit, the process unit comprising:

a photosensitive drum; and a developing section having a developing roller configured to develop an image on the photosensitive drum by toner during an image forming operation, the toner cartridge comprising:

a first frame having a first opening for providing communication of toner between inside of the first frame and outside of the first frame;

a first shutter movable between a first opening position where the first shutter opens the first opening and a first closing position where the first shutter closes the first opening;

a second frame having a second opening configured to provide communication of waste toner between inside of the second frame and outside of the second frame; and a second shutter movable between a second opening position where the second shutter opens the second opening and a second closing position where the second shutter closes the second opening, wherein the developing section is movable with the toner cartridge relative to the photosensitive drum, wherein the first frame with the first opening is movable relative to the second frame with the second opening when the toner cartridge is attached to the developing section.

6. The image forming apparatus according claim 5, wherein the first frame has a toner accommodating chamber configured to accommodate toner and a waste-toner accommodating chamber configured to accommodate waste toner.

7. The image forming apparatus according claim 6, wherein the second frame further has a third opening configured to provide fluid communication between an inside of the second frame and an inside of the waste-toner accommodating chamber.

8. The image forming apparatus according claim 5, wherein the second frame is a waste-toner conveying pipe.

9. The image forming apparatus according to claim 5, wherein a position of the second frame relative to the photosensitive drum is fixed.

10. The image forming apparatus according to claim 5, wherein the photosensitive drum has an axis extending in an axial direction, and wherein the first frame is movable relative to the second frame in a direction perpendicular to the axial direction.

11. A toner cartridge detachably attachable to a developing section, the toner cartridge comprising:

a frame having a first opening for providing communication of toner between inside of the frame and outside of the frame;

a first shutter movable between a first opening position where the first shutter opens the first opening and a first closing position where the first shutter closes the first opening;

a waste-toner conveying member having a second opening configured to provide communication of waste toner between inside of the waste-toner conveying member and outside of the waste-toner conveying member; and a second shutter movable between a second opening position where the second shutter opens the second opening and a second closing position where the second shutter closes the second opening, wherein the frame with the first opening is movable relative to the waste-toner conveying member with the second opening when the toner cartridge is attached to the developing section.

12. The toner cartridge according claim 11, wherein the frame has a toner accommodating chamber configured to accommodate toner and a waste-toner accommodating chamber configured to accommodate waste toner.

13. The toner cartridge according claim 12, wherein the waste-toner conveying member further has a third opening configured to provide fluid communication between an inside of the waste-toner conveying member and an inside of the waste-toner accommodating chamber.

14. The toner cartridge according claim 11, wherein the waste-toner conveying member is a waste-toner conveying pipe.

15. An image forming apparatus for use with a process unit and a toner cartridge detachably attachable to the process unit, the process unit comprising:

a photosensitive drum; and a developing section having a developing roller configured to develop an image on the photosensitive drum by toner during an image forming operation, the toner cartridge comprising:

a frame having a first opening for providing communication of toner between inside of the frame and outside of the frame;

a first shutter movable between a first opening position where the first shutter opens the first opening and a first closing position where the first shutter closes the first opening;

a waste-toner conveying member having a second opening configured to provide communication of waste toner between inside of the waste-toner conveying member and outside of the waste-toner conveying member; and a second shutter movable between a second opening position where the second shutter opens the second opening and a second closing position where the second shutter closes the second opening, wherein the developing section is movable with the toner cartridge relative to the photosensitive drum, wherein the frame with the first opening is movable relative to the waste-toner conveying member with the second opening when the toner cartridge is attached to the developing section.

16. The image forming apparatus according claim 15, wherein the frame has a toner accommodating chamber configured to accommodate toner and a waste-toner accommodating chamber configured to accommodate waste toner.

17. The image forming apparatus according claim 16, wherein the waste-toner conveying member further has a third opening configured to provide fluid communication between an inside of the waste-toner conveying member and an inside of the waste-toner accommodating chamber.

18. The image forming apparatus according claim 15, wherein the waste-toner conveying member is a waste-toner conveying pipe.

19. The image forming apparatus according to claim 15, wherein a position of the waste-toner conveying member relative to the photosensitive drum is fixed.

20. The image forming apparatus according to claim 15, wherein the photosensitive drum has an axis extending in an axial direction, and wherein the frame is movable relative to the waste-toner conveying member in a direction perpendicular to the axial direction.

* * * * *